US009930969B2

(12) United States Patent
Shimada et al.

(10) Patent No.: US 9,930,969 B2
(45) Date of Patent: Apr. 3, 2018

(54) BED APPARATUS

(71) Applicant: PARAMOUNT BED CO., LTD., Tokyo (JP)

(72) Inventors: Tatsuya Shimada, Tokyo (JP); Dan Kageyama, Tokyo (JP); Eita Hirai, Tokyo (JP); Shinnosuke Kubota, Tokyo (JP)

(73) Assignee: PARAMOUNT BED CO., LTD., Tokyo (JP)

( * ) Notice: Subject to any disclaimer, the term of this patent is extended or adjusted under 35 U.S.C. 154(b) by 0 days.

(21) Appl. No.: 14/889,195

(22) PCT Filed: Mar. 27, 2014

(86) PCT No.: PCT/JP2014/058730
§ 371 (c)(1),
(2) Date: Nov. 5, 2015

(87) PCT Pub. No.: WO2014/185161
PCT Pub. Date: Nov. 20, 2014

(65) Prior Publication Data

US 2016/0120327 A1 May 5, 2016

(30) Foreign Application Priority Data

May 13, 2013 (JP) ..... 2013-101512

(51) Int. Cl.
*A61G 13/08* (2006.01)
*A47C 19/04* (2006.01)
(Continued)

(52) U.S. Cl.
CPC ..... *A47C 19/045* (2013.01); *A47C 19/12* (2013.01); *A61G 7/005* (2013.01); *A61G 7/012* (2013.01);
(Continued)

(58) Field of Classification Search
CPC ..... A61G 13/08
(Continued)

(56) References Cited

U.S. PATENT DOCUMENTS 5,613,255 A * 3/1997 Bish ..... A61G 7/005 5/610
2005/0223491 A1* 10/2005 McCrimmon ..... A47C 19/045 5/11
(Continued)

FOREIGN PATENT DOCUMENTS

CN 2640311 Y 9/2004
JP S51-159204 U 12/1976
(Continued)

OTHER PUBLICATIONS

International Preliminary Report on Patentability for corresponding International Application No. PCT/JP2014/058730 dated Nov. 17, 2015. English language translation.
(Continued)

*Primary Examiner* — Fredrick C Conley
(74) *Attorney, Agent, or Firm* — Renner Otto Boisselle & Sklar, LLP

(57) ABSTRACT

To provide a bed apparatus in which the user's posture can be easily adjusted, which can be divided into lightweight and compact sections and is easy to convey, assembly and disassemble, and has improved work efficiency and maintenance performance. The bed apparatus includes: an upper frame including a back-raising mechanism and a knee-raising mechanism; and link type lifting mechanisms for moving up and down the upper frame, and is constructed such that the link type lifting mechanisms are arranged under the upper frame on the head side and on the foot side, respectively, a connection frame that integrally joins the link type lifting mechanisms to one another, is arranged between the head-side link type lifting mechanism and the foot-side
(Continued)

link type lifting mechanism, and the operations of the back-raising mechanism and knee-raising mechanism, the head-side link type lifting mechanisms can be controlled individually or in cooperation.

16 Claims, 21 Drawing Sheets

(51) Int. Cl.

| | |
|---|---|
| ***A61G 7/005*** | (2006.01) |
| ***A61G 7/012*** | (2006.01) |
| ***A61G 7/015*** | (2006.01) |
| ***A47C 19/12*** | (2006.01) |

(52) U.S. Cl.
CPC ..... *A61G 7/015* (2013.01); *A61G 2203/74* (2013.01)

(58) Field of Classification Search
USPC ..... 5/11, 611, 600
See application file for complete search history.

(56) References Cited

U.S. PATENT DOCUMENTS

| | | | | |
|---|---|---|---|---|
| 2006/0117479 | A1 | 6/2006 | Kawakami et al. | |
| 2012/0151678 | A1 | 6/2012 | Richards | |
| 2013/0061398 | A1 | 3/2013 | Lim et al. | |
| 2013/0269710 | A1* | 10/2013 | Hight | A61G 13/04 128/845 |
| 2014/0109316 | A1* | 4/2014 | Jackson | A61G 13/0036 5/601 |

FOREIGN PATENT DOCUMENTS

| | | | |
|---|---|---|---|
| JP | 60-246714 | A | 12/1985 |
| JP | H4-115459 | U | 10/1992 |
| JP | 05-300923 | A | 11/1993 |
| JP | 09-187481 | A | 7/1997 |
| JP | 2954345 | B2 | 9/1999 |
| JP | 2004-073673 | A | 3/2004 |
| JP | 2007-190185 | A | 2/2007 |
| JP | 2007082916 | | 4/2007 |
| JP | 2009-207643 | A | 9/2009 |
| JP | 2009-240583 | A | 10/2009 |
| WO | WO 90/014816 | A1 | 12/1990 |

OTHER PUBLICATIONS

International Search Report for corresponding International Application No. PCT/JP2014/058730 dated Jul. 1, 2014.
Extended European Search Report dated Dec. 22, 2016 for corresponding European Application No. 14797180.8.
Chinese Office Action dated Jan. 5, 2017 for corresponding Chinese Application No. 201480027644.8.
Notification of Reason(s) for Refusal with English machine translation for corresponding Japanese Patent Application No. 2016-009816 dated Jul. 18, 2017.
Notice of Reason(s) for Refusal dispatched on Oct. 31, 2017 for corresponding Japanese Application No. 2016-009816 (with English translation (machine)).
Japanese Office Action dated Feb. 7, 2017 for corresponding Japanese Application No. 2016-009816.

* cited by examiner (a)

(b)

(a)

(b)

BED APPARATUS

TECHNICAL FIELD

The present invention relates to a bed apparatus, in particular relating to a bed apparatus including raising/lowering mechanisms for raising/lowering bed floor sections and a link-type lifting mechanism for moving up and down a top frame having the raising/lowering mechanisms.

BACKGROUND ART

Conventionally there have been known bed apparatuses that include a lifting mechanism for moving up and down the entire bed apparatus and raising/lowering mechanisms such as a back-raising mechanism, a knee-raising mechanism and the like, in order for the user (caretaker) to get in and off the bed apparatus or in order to make the caregiver take care of the user easily.

The back-raising mechanism actuates the back section (back bottom) for supporting the upper body, among the divided bed floor sections placed on the upper frame, to thereby raise the user's back that is in contact with the back bottom. The knee-raising mechanism actuates the knee section (knee bottom) for supporting the knees, among the divided bed floor sections placed on the upper frame, to thereby raise the user's knees.

The bed apparatus including the raising/lowering mechanisms is used at home by physically handicapped users, for example. The user can enjoy their preferable posture by using the back-raising operation and knee-raising operation of the bed apparatus (see Patent Document 1).

Use of the back-raising function and the knee-raising function of the bed apparatus allows the caregiver to take care of the user easily. In this way, the bed apparatus not only helps the actions of the user who uses the bed at home, but also supports the caregiver who takes care of the user.

As the lifting mechanisms for moving up and down the bed apparatus, parallel linkage type lifting mechanisms using parallel linkage mechanisms, X-linkage type lifting mechanisms using X-shaped linkages have been widely used.

In the bed apparatus including an X-linkage type lifting mechanism having, for example an X-linkage equipped with a linear motion actuator between the base frame and the lifting frame, a configuration has been disclosed in which a first link and a second link for the X-linkage are joined so as to be pivoted about the joint, guide members for guiding the moving members arranged at the other ends of the first and second links are provided in the lifting frame, and the guide member provided in the lifting frame has an insertion portion for receiving the moving member formed on the underside thereof outside the moving stroke of the first link's moving member after assembly while the end of the second link and the lifting frame are detachably coupled, whereby the lifting frame and the assembly of the above other components are formed as separate units. (see Patent Document 2).

According to the above configuration, in inserting the first link's moving member into the guide member provided in the lifting frame, the weight of the lifting frame can be supported by the base frame when the moving member is abutted against the top wall surface of the insertion portion. Accordingly, it is possible to improve work efficiency and reduce labor burden in assembling the bed.

PRIOR ART DOCUMENTS

Patent Documents

Patent Document 1:
Japanese Patent Application Laid-open 2009-240583
Patent Document 2:
Japanese Patent Application Laid-open 2009-207643

SUMMARY OF THE INVENTION

Problems to be Solved by the Invention

However, in the prior art configuration described above, the X-link lifting mechanism having the lifting frame moveable up and down uses a framework structure for arrangement of X-linkages in order to support the lifting frame with the X-linkages. Since this configuration increases the weight of the moving parts including the lifting frame, there has been the problem that the capacity of the actuator needs to be specified to deal with high loads.

Accordingly, in the prior art configuration, though the bed apparatus is divided into separate units, each unit is heavy and large so that there has been room for improvement in conveyance, assembly and disassembly and others. Especially, for home-use beds and nursing beds, there has been a demand for abed apparatus that can be divided into lightweight and compact sections and that is easy to convey, assemble and disassemble.

Further, there is also a demand for a bed apparatus in which the user's posture can be easily adjusted to the position the user wants without putting any physical strain on the user when the position of the user on the bed needs to be changed.

In view of the above-described conventional problems, it is therefore an object of the present invention to provide a bed apparatus in which the user's posture can be easily adjusted, which can be divided into lightweight and compact sections and is easy to convey, assembly and disassemble, has improved work efficiency and maintenance performance, and allows easy adjustment to the position the user wants.

Means for Solving the Problems

The bed apparatus according to the present invention for solving the above problems is configured as follows:—

The present invention resides in a bed apparatus comprising: an upper frame including a raising/lowering mechanism for raising/lowering a bed floor section; and link type lifting mechanisms for moving up and down the upper frame, wherein the link type lifting mechanisms are arranged under the upper frame on the head side and on the foot side, respectively, a connection frame that integrally joins the link type lifting mechanisms to one another, is arranged between the head-side link type lifting mechanism and the foot-side link type lifting mechanism, and the operations of the raising/lowering mechanism, the head-side link type lifting mechanism and the foot-side link type lifting mechanism can be controlled individually or in cooperation.

It is preferable in the present invention that the raising/lowering mechanism includes a raising/lowering link acting on the bed floor section and a driving means for driving the raising/lowering link, between the bed floor section and the upper frame, and, the raising/lowering link is configured so that one end is pivotally coupled with the upper frame side while the other end comes into and out of contact with the bed floor section while the driving means makes the other end abut the bed floor section and urge the bed floor section in the pushing-up direction only.

It is also preferable in the present invention that the bed floor section includes a back section (a so-called back bottom) for the upper body (the upper half of the body), the raising/lowering mechanism includes a back section-raising/lowering mechanism (a so-called back-raising mechanism) for raising and lowering the back section, the back section-raising/lowering mechanism includes a back section-raising/lowering link acting on the back section as the raising/lowering link, and a driving means (e.g., a linear actuator) for driving the back section-raising/lowering link, between the back section and the upper frame, and, the back section-raising/lowering link is configured so that one end is pivotally coupled with the upper frame side while the driving means makes the other end abut the back section and urge the back section in the pushing-up (raising) direction only.

It is also preferable in the present invention that the bed floor section includes a knee section for knee bending, the raising/lowering mechanism includes a knee section-raising/lowering mechanism (a so-called knee-raising mechanism) for raising and lowering the knee section, the knee section-raising/lowering mechanism includes a knee section-raising/lowering link acting on the knee section as the raising/lowering link, and a driving means (e.g., a linear actuator) for driving the knee section-raising/lowering link, between the knee section and the upper frame, and, the knee section-raising/lowering link is configured so that one end is pivotally coupled with the upper frame side while the driving means makes the other end abut the knee section and urge the knee section in the pushing-up (raising) direction only.

It is also preferable in the present invention that the link type lifting mechanisms each have an X-linkage formed of a first link and a second link that are rotationally coupled at their medium positions and act on a lift assembly, arranged between a base assembly (e.g., a "lower frame" if given as a framework) and the lift assembly (e.g., a "upper frame" if given as a framework), the first link is arranged so that one end is pivotally coupled with the lift assembly and the other end is coupled with the base assembly so as to move along the base assembly, the second link is arranged so that one end is pivotally coupled with the base assembly and the other end is coupled with the lift assembly so as to move along the lift assembly, a third link acting on the linkage and a driving means (e.g., a linear actuator) for driving the third link are provided between the base assembly and the lift assembly, and, the third link is arranged so that one end is pivotally coupled with the base assembly or the lift assembly while the other end is arranged so as to come into or out of contact with the first link or the second link, and the driving means makes the other end abut the first link or the second link and urge the lift assembly in the raising direction only.

Effect of the Invention

According to the bed apparatus of the present invention, in a bed apparatus including an upper frame including a raising/lowering mechanism for raising/lowering a bed floor section and link type lifting mechanisms for moving up and down the upper frame, arranging the link type lifting mechanisms under the upper frame on the head side and on the foot side, respectively, makes it possible to distribute the loads (load acting on the upper frame, the weight of the upper frame itself and weights of other components acting on the link type lifting mechanisms) on the link type lifting mechanisms, to the head side and the foot side. Accordingly, it is possible to make the structure of each of the link type lifting mechanisms on the head and foot sides lightweight and compact. As a result, it is possible to realize a bed apparatus that is easy to convey, assemble and disassemble and is excellent in work efficiency and maintenance performance.

Further, provision of a connection frame that integrally joins the link type lifting mechanisms to one another, between the head-side link type lifting mechanism and the foot-side link type lifting mechanism, makes it possible to simplify the lower frame that supports the upper frame without providing any base frame (framework) and the like for mounting the link type lifting mechanisms. That is, the lower frame can be separated into three parts, the head-side link type lifting mechanism, the foot-side link type lifting mechanism and the connection frame, hence it is possible to realize a lightweight and compact lower frame.

Moreover, since the operations of the raising/lowering mechanism, the head-side link type lifting mechanism and the foot-side link type lifting mechanism can be controlled individually or in cooperation, it is possible to easily perform a movement of changing the posture of the user by combining the back-raising operation and the bed floor section lifting operations on the head side and foot side, in combination. As a result, it is possible to readily adjust the user's posture to the position the user wants.

The thus configured bed apparatus is the best for the bed to be used at home where much help cannot be expected.

According to the present invention, the raising/lowering mechanism is adapted to include a raising/lowering link acting on the bed floor section and a driving means for driving the raising/lowering link, between the bed floor section and the upper frame, and, the raising/lowering link is configured so that one end is pivotally coupled with the upper frame side while the other end comes into and out of contact with the bed floor section while the driving means makes the other end abut the bed floor section and urge the bed floor section in the pushing-up direction only. This configuration makes the bed floor section free from linkage in raising and lowering operation, it is hence possible to manually perform raising and lowering operation without relying on the driving means. As a result, it is possible to improve work efficiency and maintenance performance and also reduce the risk of property damage, or equipment being caught as a result of drive of the driving means during a bed floor section lowering operation.

According to the present invention, the bed floor section includes a back section (a so-called back bottom) for the upper body (the upper half of the body), the raising/lowering mechanism includes a back section-raising/lowering mechanism (a so-called back-raising mechanism) for raising and lowering the back section, the back section-raising/lowering mechanism includes a back section-raising/lowering link acting on the back section as the raising/lowering link, and a driving means (e.g., a linear actuator) for driving the back section-raising/lowering link, between the back section and the upper frame, and, the back section-raising/lowering link is configured so that one end is pivotally coupled with the upper frame side while the driving means makes the other end abut the back section and urge the back section in the pushing-up (raising) direction only. This configuration makes it possible to perform back-raising operations smoothly and make the back section free from linkage in back-lowering operation. Accordingly, it is possible to perform a back-raising operation manually without relaying on the driving means. As a result, it is possible to improve work efficiency and maintenance performance and also reduce the risk of property damage, or equipment being caught as a result of drive of the driving means during a back lowering operation.

Further, according to the present invention, the bed floor section includes a knee section for knee bending, the raising/lowering mechanism includes a knee section-raising/lowering mechanism (a so-called knee-raising mechanism) for raising and lowering the knee section, the knee section-raising/lowering mechanism includes a knee section-raising/lowering link acting on the knee section as the raising/lowering link, and a driving means (e.g., a linear actuator) for driving the knee section-raising/lowering link, between the knee section and the upper frame, and, the knee section-raising/lowering link is configured so that one end is pivotally coupled with the upper frame side while the driving means makes the other end abut the knee section and urge the knee section in the pushing-up (raising) direction only. This configuration makes it possible to perform knee-raising operations smoothly and make the knee section free from linkage in knee-lowering operation. Accordingly, it is possible to perform a knee-raising operation manually without relaying on the driving means. As a result, it is possible to improve work efficiency and maintenance performance and also reduce the risk of property damage, or equipment being caught as a result of drive of the driving means during a knee lowering operation.

According to the present invention, the link type lifting mechanisms each have an X-linkage formed of a first link and a second link that are rotationally coupled at their medium positions and act on a lift assembly, arranged between a base assembly and the lift assembly, the first link is arranged so that one end is pivotally coupled with the lift assembly and the other end is coupled with the base assembly so as to move along the base assembly, the second link is arranged so that one end is pivotally coupled with the base assembly and the other end is coupled with the lift assembly so as to move along the lift assembly, a third link acting on the linkage and a driving means for driving the third link are provided between the base assembly and the lift assembly, and, the third link is arranged so that one end is pivotally coupled with the base assembly or the lift assembly while the other end is arranged so as to come into or out of contact with the first link or the second link, and the driving means makes the other end abut the first link or the second link and urge the lift assembly in the raising direction only. It is hence possible to make the linkage simple and compact without using any framework structure, hence reduce costs and improve assemble performance and maintenance performance. Further, this configuration makes the lift assembly free from linkage in lowering operation. This also makes it possible to reduce the risk of property damage, or equipment being caught as a result of drive of the driving means in lowering the lift assembly because the lift assembly is made free from linkage in lowering movement.

MODE FOR CARRYING OUT THE INVENTION

Now, the embodiment mode of the bed apparatus of the present invention will be described in detail with reference to the drawings.

Figure 1:
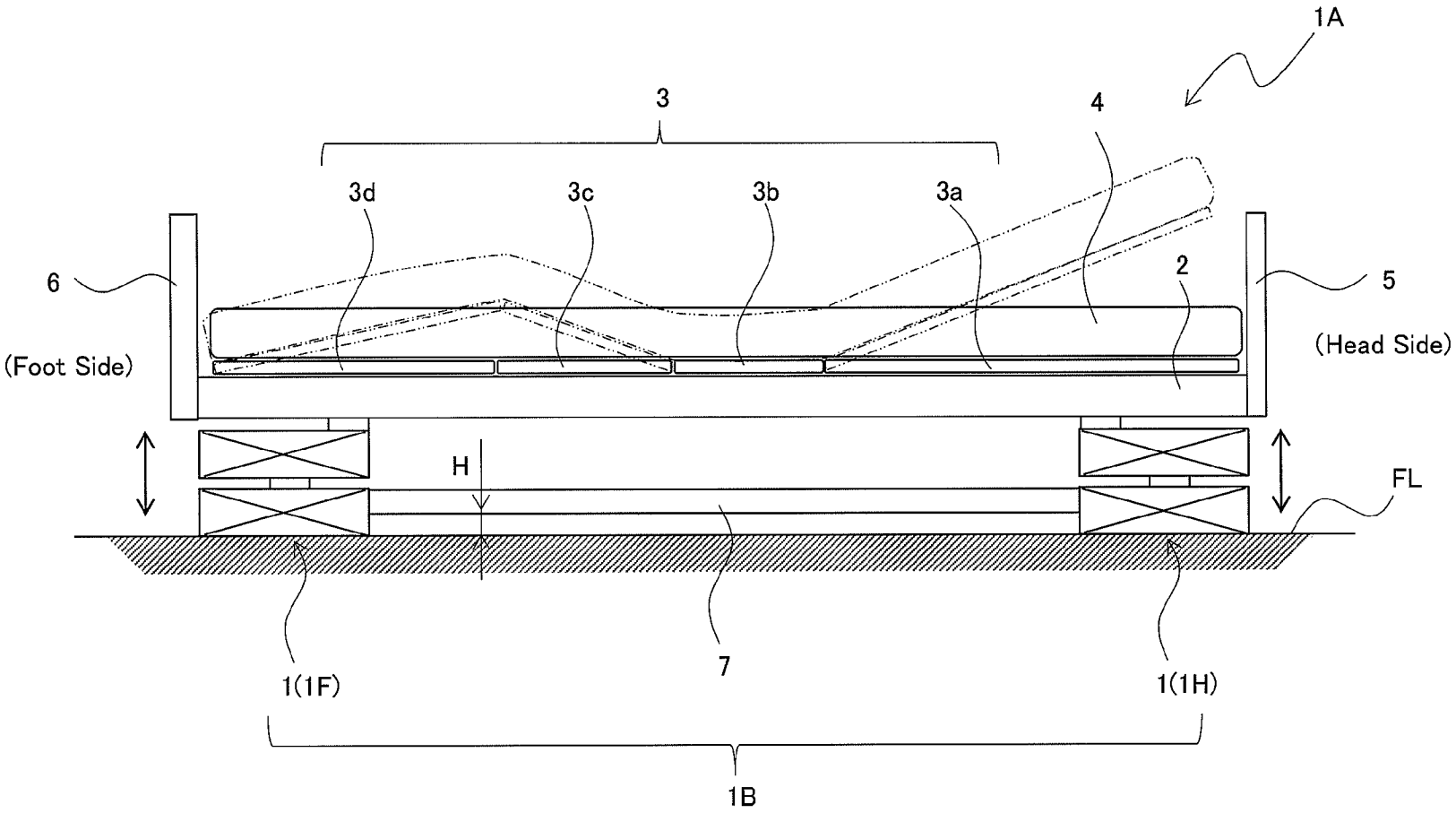
FIG. 1 An illustrative view showing an overall configuration of a bed apparatus according to an embodiment of the present invention.

FIG. 1 is an illustrative view of one example of the embodiment mode of the present invention, showing an overall configuration of a bed apparatus according to the present embodiment of the present invention.

A bed apparatus 1A according to the present embodiment includes: as shown in FIG. 1, a mattress 4; divided bottoms (bed floor sections) 3 placed on the mattress 4; raising/lowering mechanisms for moving up and down part of the divided bottoms 3; an upper frame 2 having the raising/lowering mechanisms; and link type lifting mechanisms 1 for moving up and down the upper frame 2. In this bed apparatus, link type lifting mechanisms 1H and 1F are arranged under the upper frame 2 on the head side and the foot side, respectively to move up and down the upper frame 2.

Arranged on top of the upper frame 2 are the divided bottoms (bed floor sections) 3. The bottoms 3 include a back bottom (back section) 3*a*, a hip bottom 3*b*, a knee bottom (knee section) 3*c* and a foot bottom 3*d*. Placed on the divided bottoms 3 is the mattress 4. A head board 5 and a foot board 6 are disposed on the head side and the foot side of the upper frame 2, respectively.

Arranged between the head side link type lifting mechanism 1H and the foot side link type lifting mechanism 1F is a connection frame 7 for connecting the link type lifting mechanisms 1H and 1F.

In the present embodiment, the head-side link type lifting mechanism 1H, the foot-side link type lifting mechanism 1F and the connection frame 7 form the lower frame 1B of the bed apparatus 1A.

The head-side link type lifting mechanism 1H and the foot-side link type lifting mechanism 1F are configured to be controllable to move up and down individually or in cooperation with each other.

To begin with, the configuration of the upper frame 2 that characterizes the bed apparatus 1A of the present embodiment will be described in detail with reference to the drawings.

Figure 2:
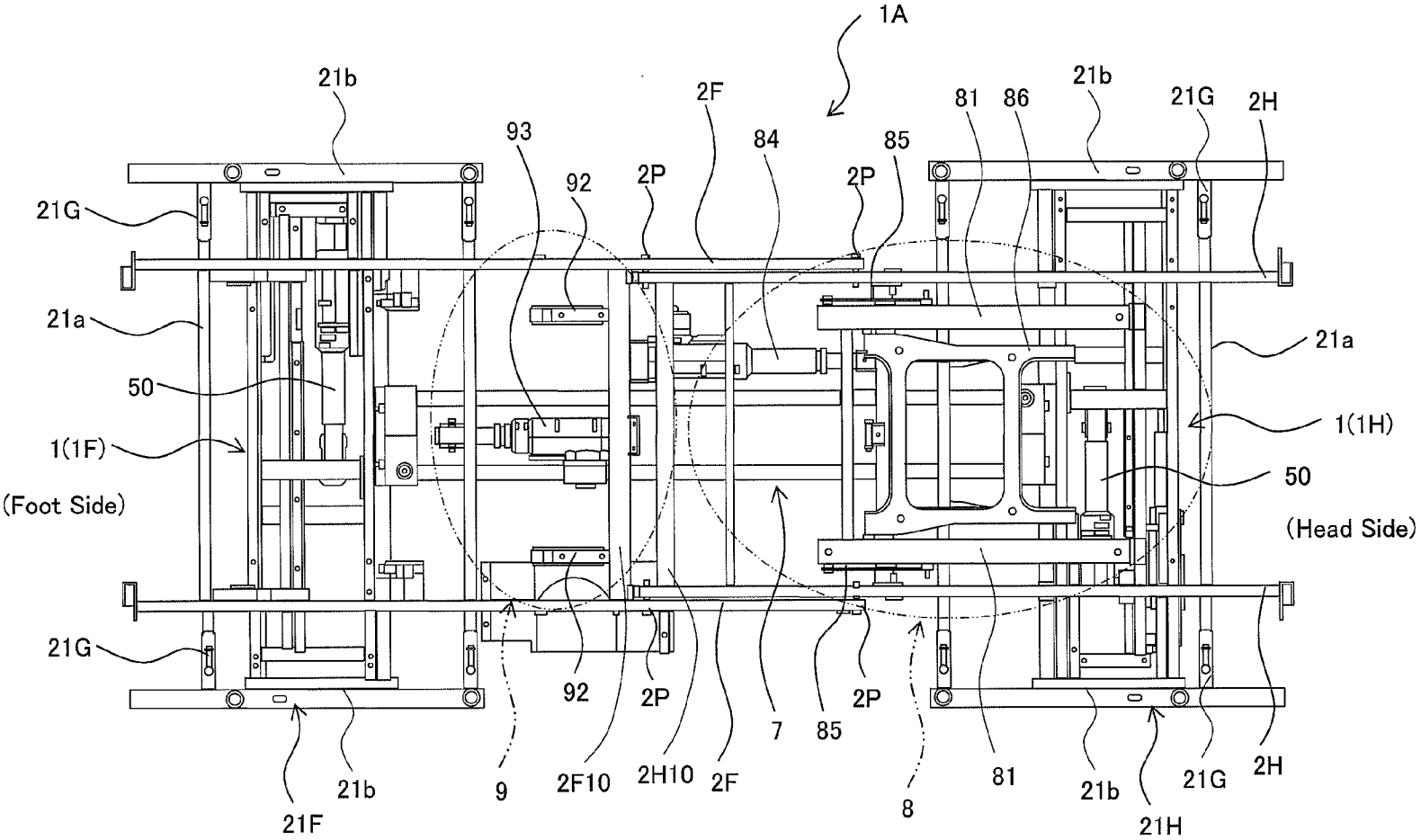
FIG. 2 A plan view showing a configuration of a frame structure including functional mechanisms of the bed apparatus.
Figure 3:
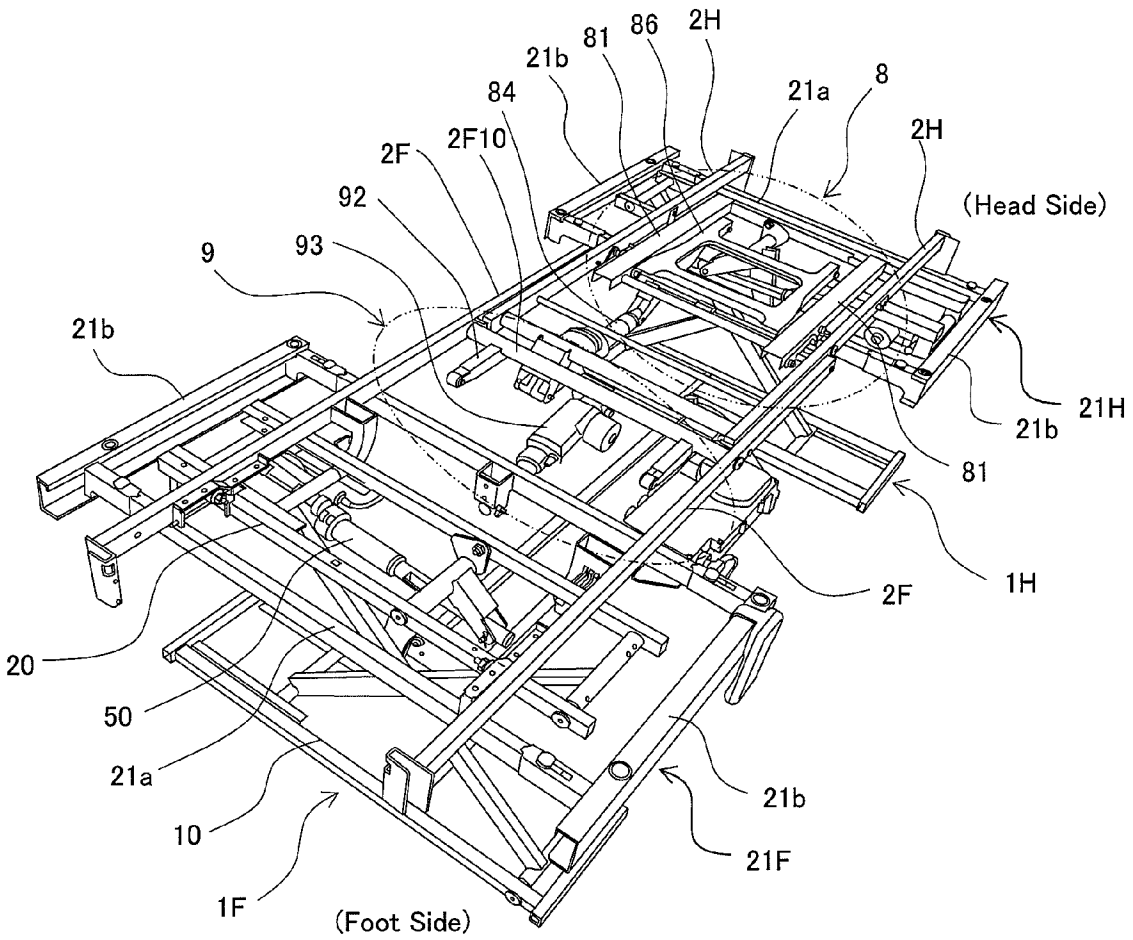
FIG. 3 A perspective view showing a configuration of a frame structure of the bed apparatus.

FIG. 2 is a plan view showing a configuration of the frame structure including functional mechanisms of the bed apparatus of the present embodiment. FIG. 3 is a perspective view showing a configuration of the frame structure of the bed apparatus.

As shown in FIGS. 2 and 3, the upper frame 2 is composed of a pair of head-side frame 2H, 2H forming the head side of the bed apparatus 1A and a pair of foot-side frame 2F, 2F forming the foot side of the bed apparatus 1A, so as to construct an overall ladder-like structure that is longer from the head side to the foot side than in the width direction.

The head-side frames 2H, 2H and the foot-side frames 2F, 2F are spaced a predetermined distance from each other, and disposed over the head-side link type lifting mechanism 1H and the foot-side link type lifting mechanism 1F, respectively, and can be coupled so as to be assembled and disassembled by unillustrated connection members.

As shown in FIG. 2, the head-side frame 2H and the foot-side frame 2F are disposed side by side in the longitudinal direction and coupled so as to be assembled and disassembled by joint pins 2P with parts of them overlapped in the width direction.

Arranged between the head-side frames 2H, 2H is a so-called back-raising mechanism 8 as a raising/lowering mechanism for tilting up or down the upper body (back) of the user.

Arranged between the foot-side frames 2F, 2F is a so-called knee-raising mechanism 9 as a raising/lowering mechanism for tilting up or down the knees of the user.

Joined on the underside of the head-side frames 2H, 2H and the foot-side frames 2F, 2F are rectangular frames 21H and 21F to which optional side rails and others are attached.

The head-side link type lifting mechanism 1H is arranged under the head-side rectangular frame 21H while the foot-side link type lifting mechanism 1F is arranged under the foot-side rectangular frame 21F.

Rectangular frames 21H, 21F are each formed of a pair of long frames 21*a*, 21*a* and a pair of attachment frames 21*b*, 21*b* and connection members 21G.

The attachment frames 21*b* are joined to the long frames 21*a* by the connection members 21G so that the attachment frames 21*a* can be adjusted in position with respect to the width direction.

Next, the configurations of the back-raising mechanism 8 and the knee-raising mechanism 9 that characterize the raising/lowering mechanisms of the present embodiment will be described in detail with reference to the drawings.

Figure 4:
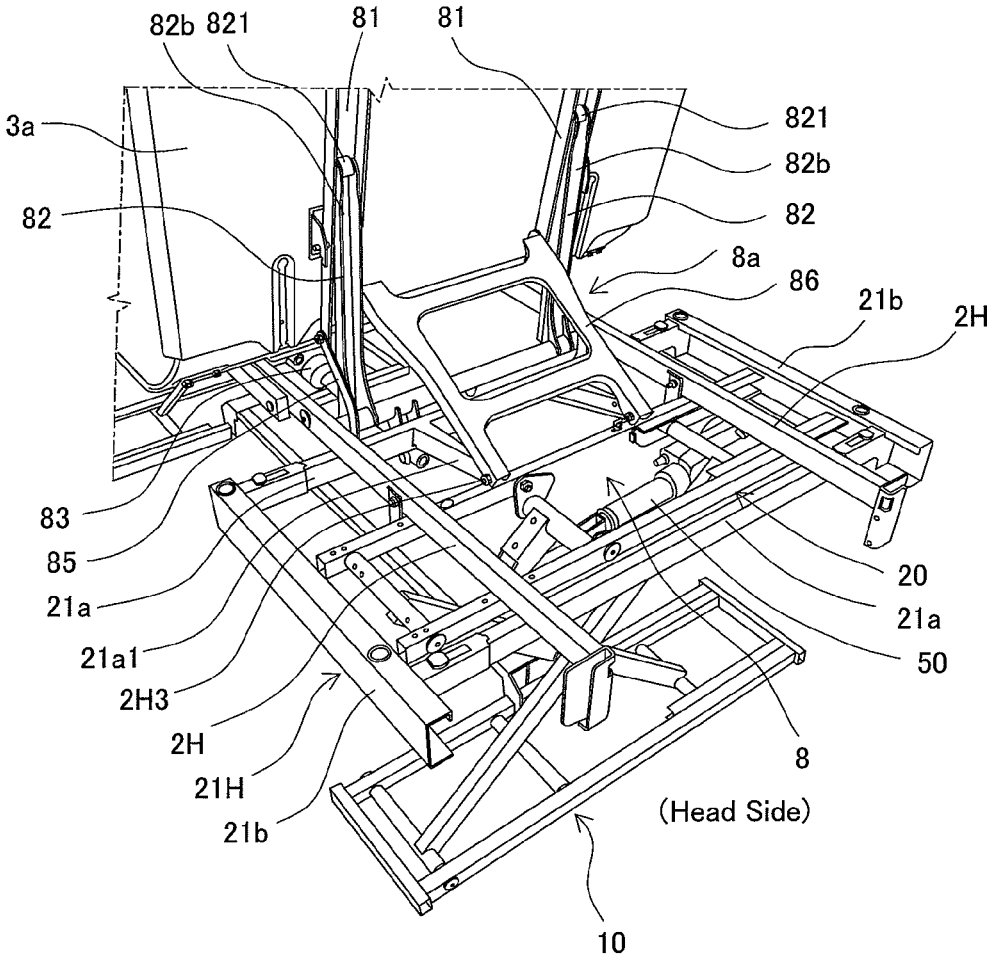
FIG. 4 An illustrative view showing a configuration of a back-raising mechanism for the bed apparatus.
Figure 5:
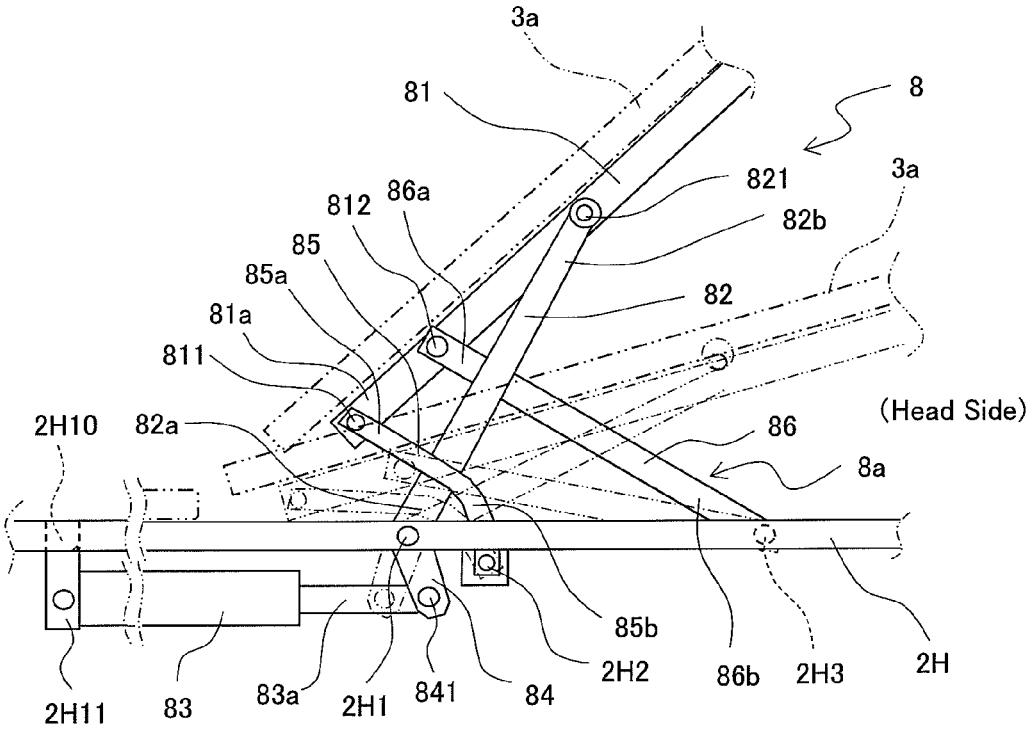
FIG. 5 A schematic side view of the back-raising mechanism shown in FIG. 4.
Figure 6:
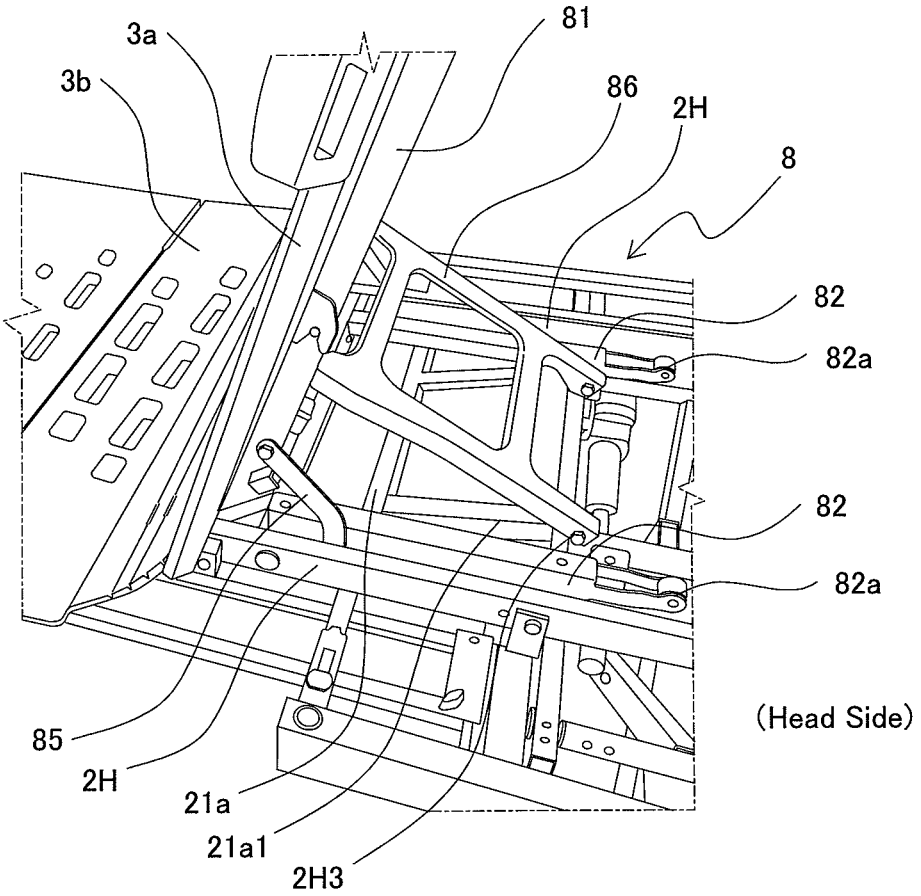
FIG. 6 An illustrative view showing a state where the back-raising mechanism is manually operated.
Figure 7:
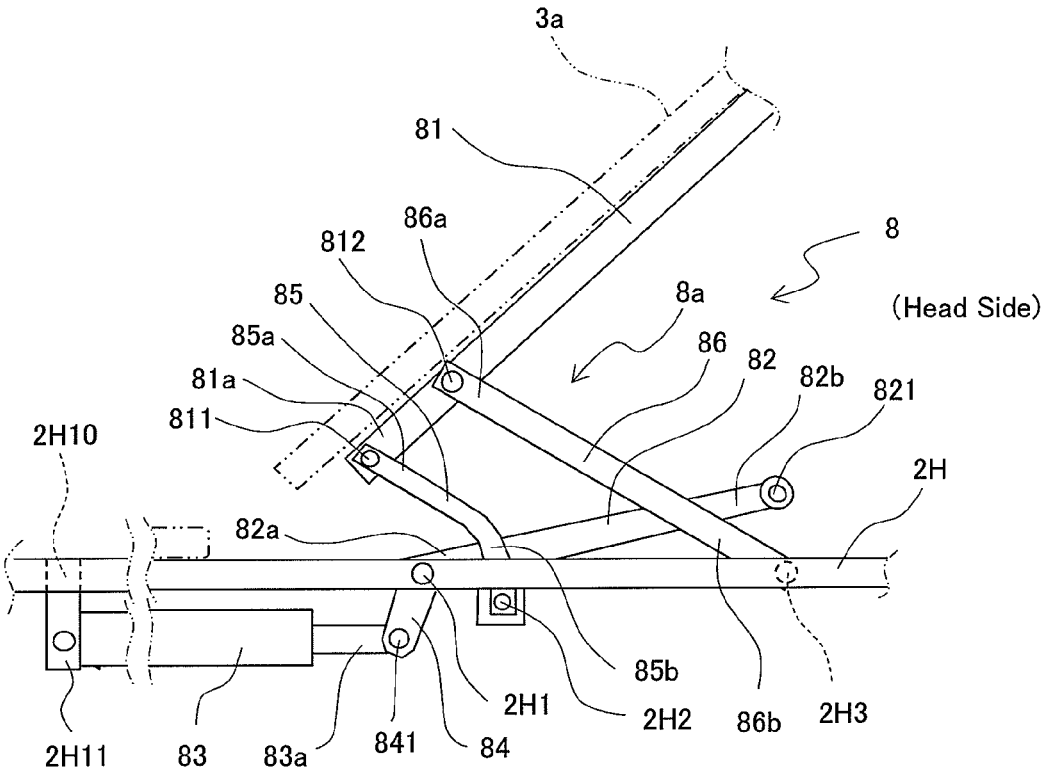
FIG. 7 A schematic side view of the back-raising mechanism shown in FIG. 6.
Figure 8:
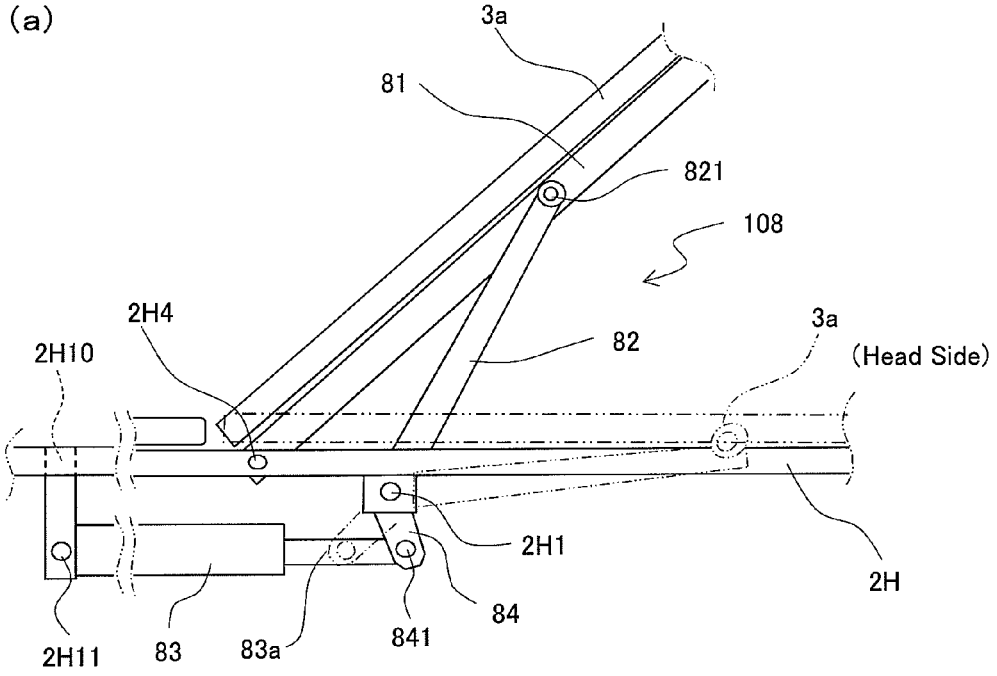
FIG. 8 (*a*) an illustrative view showing a configuration of a variational example of the back-raising mechanism, and (*b*) an illustrative view showing a state where the back-raising mechanism of the variational example is manually operated.
Figure 8:
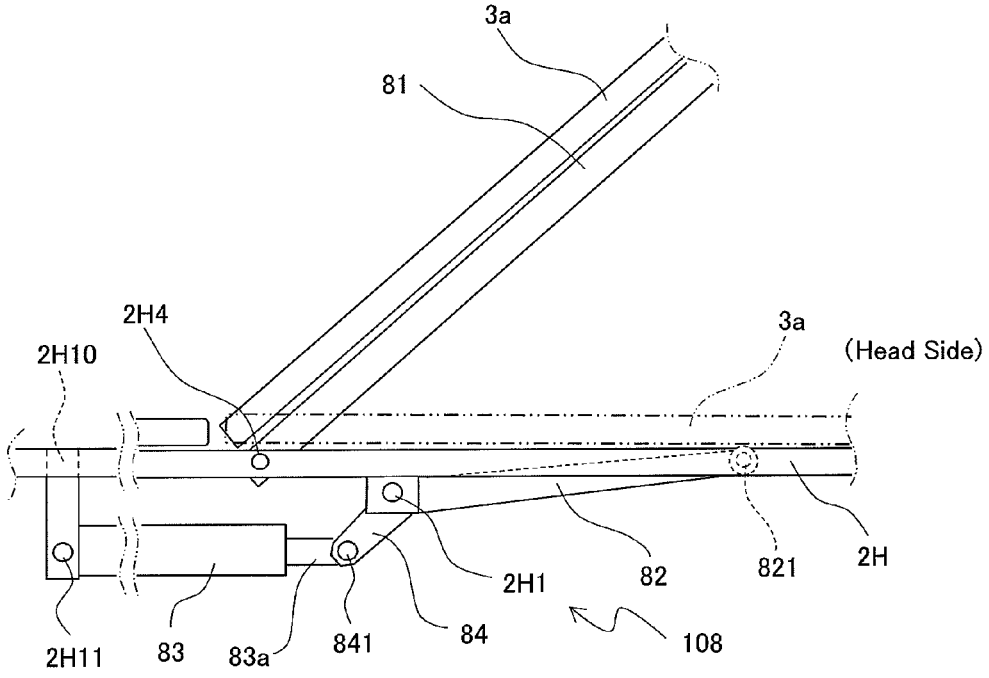
Figure 9:
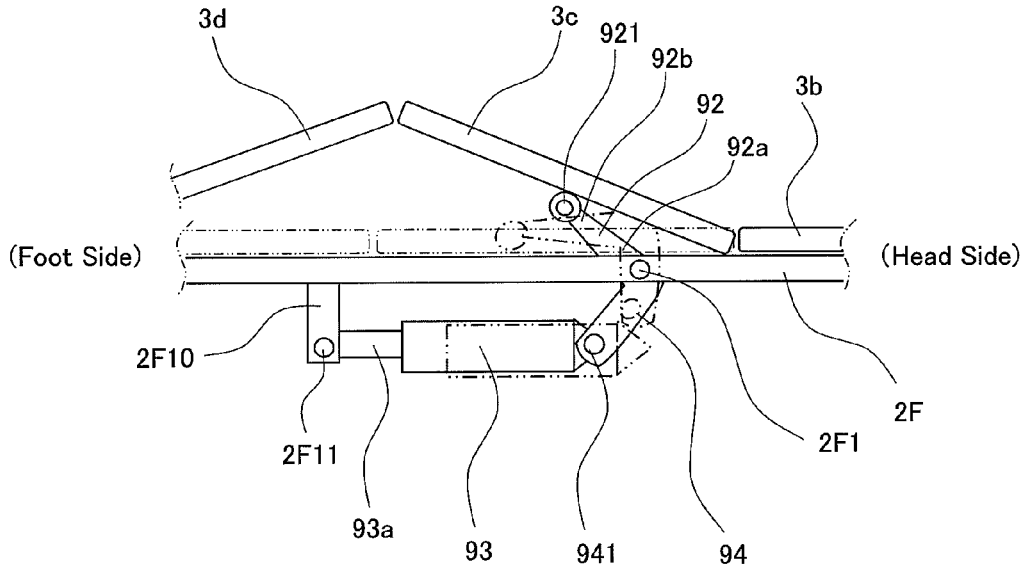
FIG. 9 (*a*) an illustrative view showing a configuration of a knee-raising mechanism of the present embodiment, and (*b*) an illustrative view showing a state where the knee-raising mechanism is manually operated.
Figure 9:
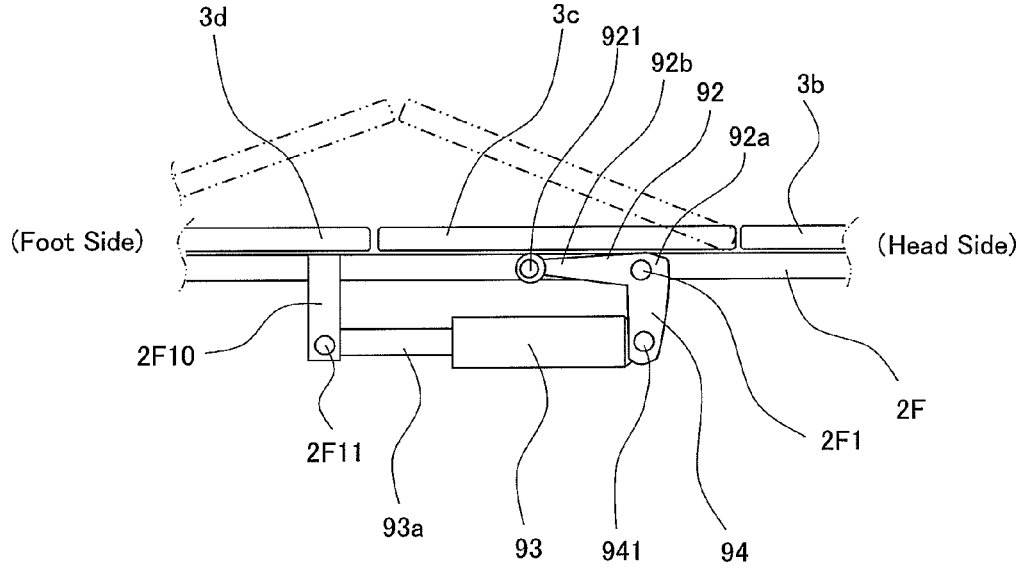

FIG. 4 is an illustrative view showing a configuration of the back-raising mechanism of the present embodiment. FIG. 5 is a schematic side view of the back-raising mechanism shown in FIG. 4. FIG. 6 is an illustrative view showing a state where the back-raising mechanism is manually operated. FIG. 7 is a schematic side view of the back-raising mechanism shown in FIG. 6. FIG. 8(*a*) is an illustrative view showing a configuration of a variational example of the back-raising mechanism, and (*b*) an illustrative view showing a state where the back-raising mechanism of the variational example is manually operated. FIG. 9 (*a*) is an illustrative view showing a configuration of a knee-raising mechanism, and (*b*) an illustrative view showing a state where the knee-raising mechanism is manually operated.

First, the back-raising mechanism 8 of the present embodiment will be described.

As shown in FIGS. 4 and 5, the back-raising mechanism 8 of the present embodiment includes: between the back bottom 3*a* and the head-side frame 2H, a pair of back bottom frames 81, 81 to which the back bottom 3*a* is attached; a pair of back-raising links (raising/lowering links) 82, 82 acting on the back bottom frames 81; a linear actuator (driving means) 83 for driving the back-raising links 82; a drive arm 84 for linking the back-raising links 82 and the linear actuator 83; and, a pair of first links 85, 85 and a pair of second links 86 for supporting the back bottom frames 81, 81 on the head-side frame 2H side.

In the present embodiment, in addition to the back-raising links 82 and the linear actuator for driving the back-raising links 82, the first links 85 and the second links 86 are each pivotally coupled to the back bottom frame 81 and the head-side frame 2H, forming a rectangular parallel linking mechanism (so-called 4-node linking mechanism formed of first links 85, second links 86, back bottom frame 81 and head-side frame 2H) 8*a*.

The back-raising link 82 is disposed so that one end 82*a* is pivotally coupled with a back-raising link joint 2H1 of the head-side frame 2H while the other end 82*b* is formed with a rotary roller 821. The back-raising link 82 and the drive arm 84 are integrally formed in an approximately L-shape and supported on a common pivot at the back-raising link joint 2H1.

The drive arm 84 has a joint 841 to be coupled with the linear actuator 83. The drive arm 84 is configured so as to pivot on the back-raising link joint 2H1 in accordance with the movement of the linear actuator 83.

The rotary roller 821 is arranged so as to come into and out of contact with the back bottom frame 81. With this arrangement, the drive force of the linear actuator 83 is adapted to raise the back bottom 3*a* in the back-raising (pushing up) direction only by pushing the rotary roller 821 against the back bottom frame 81.

The linear actuator 83 is an electric cylinder having a rod 83*a* that can be expanded and contracted by motor drive and is arranged as shown in FIG. 5 so that the front end of the rod 83*a* is coupled with the joint 841 of the drive arm 84 while the end on the body side is pivotally coupled with an attachment bracket 2H11 provided on a connection frame 2H10 of the head-side frame 2H.

The first link 85 is arranged so that one end 85*a* is pivotally coupled with a first link joint 811 formed at an end 81*a* of the back bottom frame 81 while the other end 85*b* is pivotally coupled with a first link frame side joint 2H2 provided at a position lower than the undersurface of the head-side frame 2H.

The second link 86 is formed to be longer than the first link 85. On end side 86*a* is pivotally coupled with a second link joint 812 that is disposed farther than the joint 811 of the back bottom frame 81 while the other end 86*b* is pivotally coupled with a second link frame side joint 2H3 that is disposed farther than the first link frame side joint 2H1 of the back bottom frame 81 of the head-side frame 2H.

Specifically, as shown in FIG. 4 the second link frame side joint 2H3 is formed at the end of an attachment arm 21*a*1 projected toward the head side from the long frame 21*a* of the rectangular frame 21H and located at a position that is higher than the first link frame side joint 2H2 of the first link 85 and that is farther than the back-raising link joint 2H1 of the back bottom frame 81.

When a back-raising operation is performed by the back-raising mechanism 8 of the bed apparatus 1A of the present embodiment, as shown in FIG. 5, the back bottom frame 81 (hence, also together with the back bottom 3*a*) can be tilted upward whilst being shifted toward the head side (rightward in the drawing). As a result, it is possible to make the user on the bed perform the back-raising operation in a comfortable posture.

In the present embodiment, the back-raising links 82 are configured so that the linear actuator 83 urges the back bottom 3*a* in the pushing-up direction only by abutting the rotary roller 821 against the back bottom frame 81.

Here in the present embodiment, the back-raising mechanism 8 includes parallel link mechanism 8*a*, but the present invention should not be limited to this configuration.

As one variational example of the back-raising mechanism 8, a back-raising mechanism 108 may be configured as shown in FIGS. 8(*a*) and 8(*b*), with the end of the back bottom frame 81 coupled with the head-side frame 2H, pivotally about a back bottom frame joint 2H4 as a fulcrum so that the back bottom frame 81 can be rotated by the back-raising link 82 without use of the parallel link mechanism 8*a*.

The rotary roller 821 is arranged so as to come into and out of contact with the back bottom frame 81 in the same manner as in the configuration of the above described back-raising mechanism 8. With this arrangement, the drive force of the linear actuator 83 is adapted to raise the back bottom 3*a* in the back-raising (pushing up) direction only by pressing the rotary roller 821 against the back bottom frame 81.

Next, the knee-raising mechanism 9 of the present invention will be described.

As shown in FIGS. 3 and 9(*a*), the knee-raising mechanism 9 of the present embodiment includes: between the knee bottom 3*c* and the foot-side frame 2F, knee-raising links 92, 92 acting on the knee bottom 3*c* as raising/lowering links; a linear actuator (driving means) 93 for driving the knee-raising links 92; and, a drive arm 94 for linking the knee-raising links 92 with the linear actuator 93.

The knee-raising link 92 is disposed so that one end 92*a* is pivotally coupled with a knee-raising link joint 2F1 of the foot-side frame 2F while the other end 92*b* is formed with a rotary roller 921. The knee-raising link 92 and the drive arm 94 are integrally formed in an approximately L-shape and supported on a common pivot at the knee-raising link joint 2F1.

The drive arm 94 has a joint 941 to be coupled with the linear actuator 93. The drive arm 94 is configured so as to pivot about the knee-raising link joint 2F1 as a fulcrum in accordance with the movement of the linear actuator 93.

The rotary roller 921 is arranged so as to come into and out of contact with the knee bottom 3*c*. With this arrangement, the drive force of the linear actuator 93 is adapted to raise the knee bottom 3*c* in the knee-raising (pushing up) direction only by pushing the rotary roller 921 against the knee bottom 3*c*.

The linear actuator 93 is an electric cylinder having a rod 93*a* that can be expanded and contracted by motor drive and is arranged as shown in FIG. 9 so that the end on the body side is coupled with the joint 941 of the drive arm 94 while the front end of the rod 93*a* is pivotally coupled with an attachment bracket 2H11 provided on a connection frame 2F10 of the foot-side frame 2F.

When a knee-raising operation is performed by the knee-raising mechanism 9 of the bed apparatus 1A of the present embodiment, as the knee bottom 3*c* is pushed upward by the knee-raising links 92 as shown in FIG. 9, the knee bottom 3*c* can be tilted so that the user's knees move upward and bend. As a result, it is possible to easily make the user on the bed perform the knee-raising operation.

In the present embodiment, the knee-raising link 92 is configured so that the linear actuator 93 urges the knee bottom 3*c* in the pushing-up direction only by abutting the roller 921 against the knee bottom 3*c*.

Next, the lower frame 1B characterizing the bed apparatus 1A of the present embodiment will be described in detail with reference to the drawings.

Figure 10:
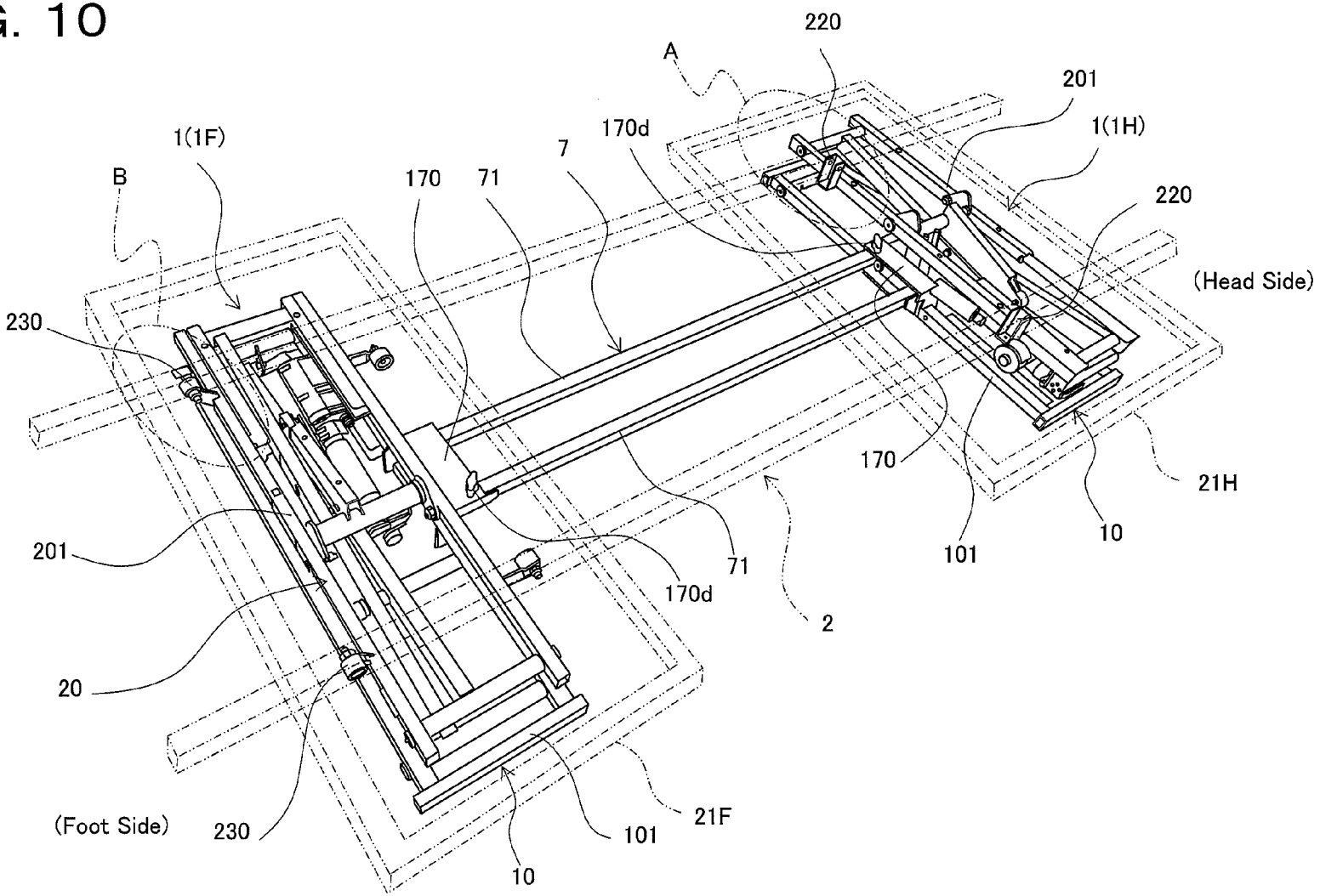
FIG. 10 An illustrative view showing a configuration of a lower frame of the bed apparatus.
Figure 11:
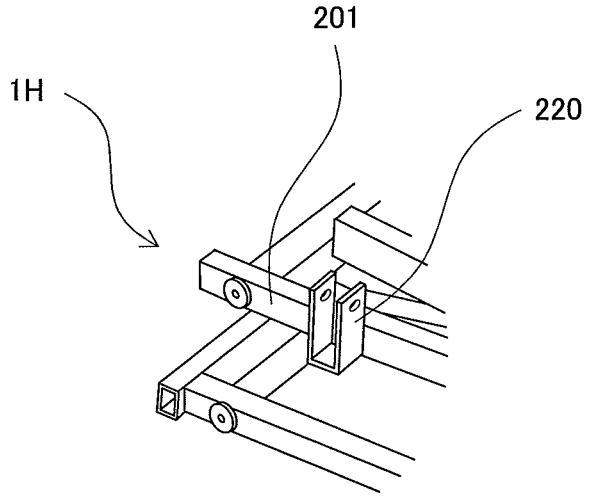
FIG. 11 An enlarged view of an area A in FIG. 10, showing the arrangement of a supporting part of the lower frame for supporting the upper frame.
Figure 12:
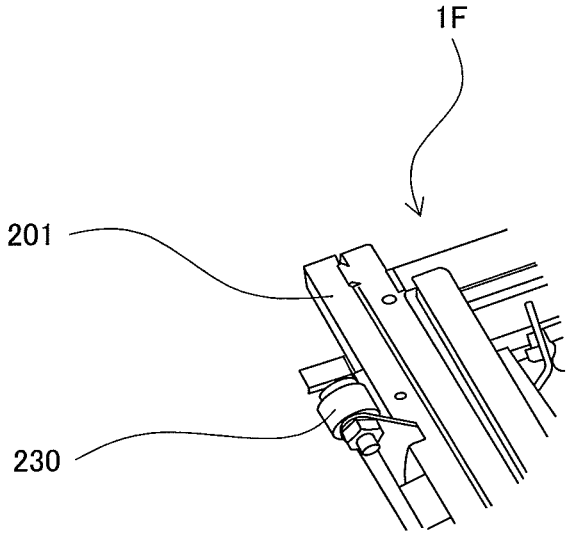
FIG. 12 An enlarged view of an area B in FIG. 10, showing the arrangement of a retention roller for retaining the upper frame in the lower frame.
Figure 13:
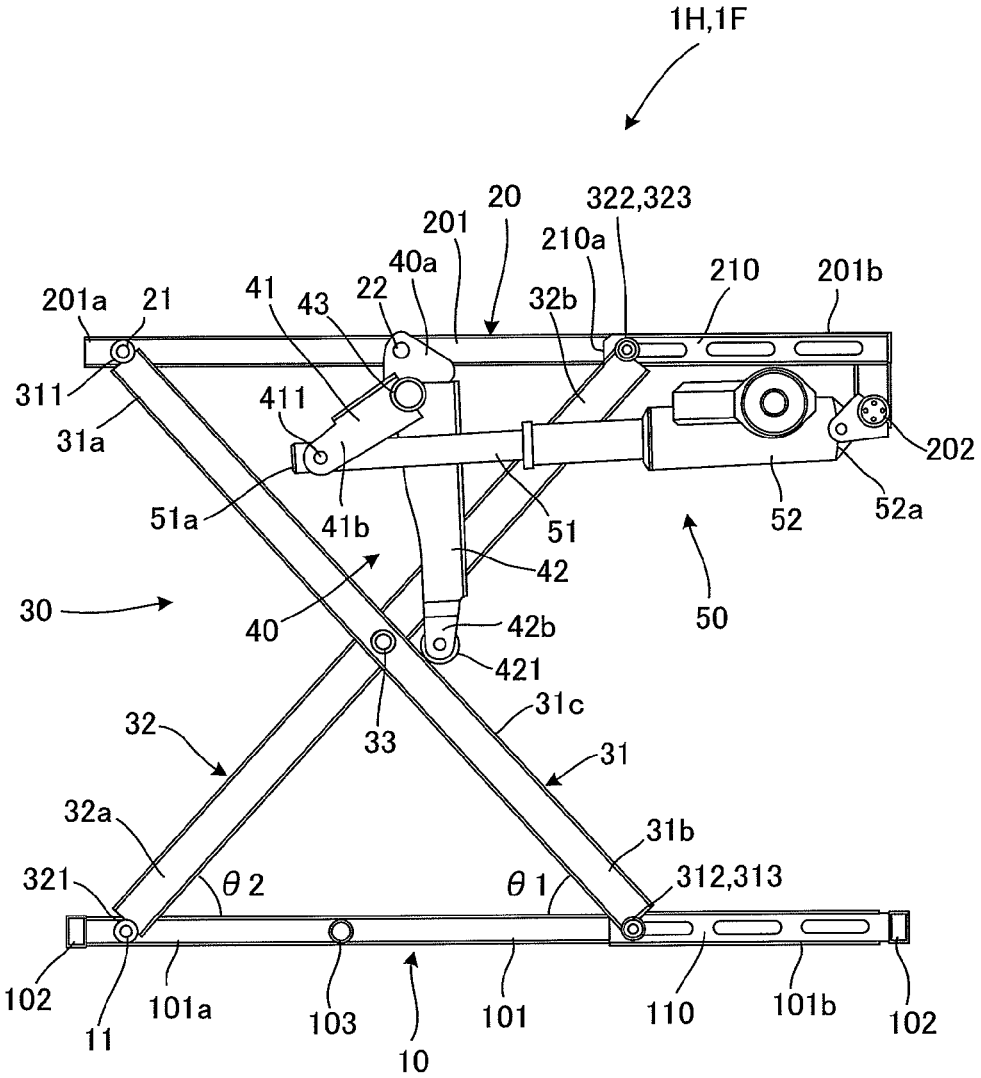
FIG. 13 An illustrative view showing the overall configuration (in a raised state) of a link type lifting mechanism that constitutes the lower frame.
Figure 14:
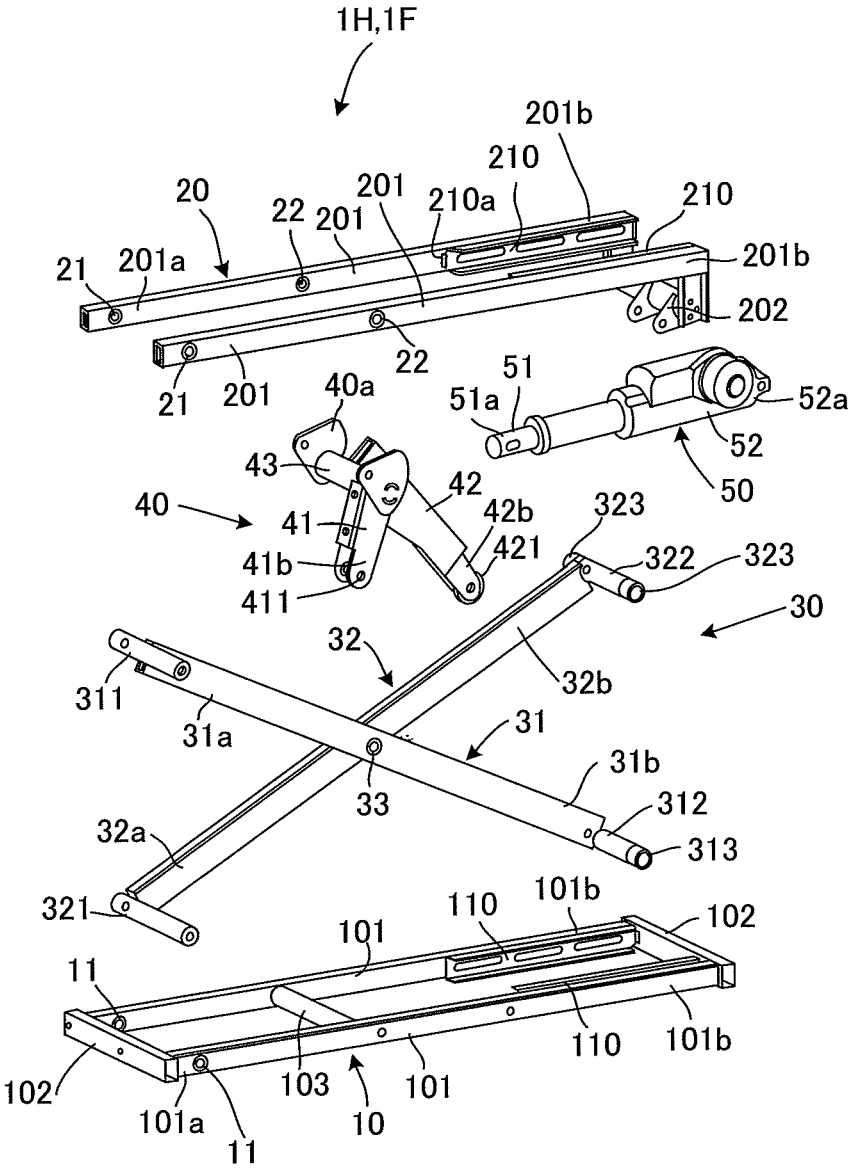
FIG. 14 An exploded view showing the configuration of the link type lifting mechanism.
Figure 15:
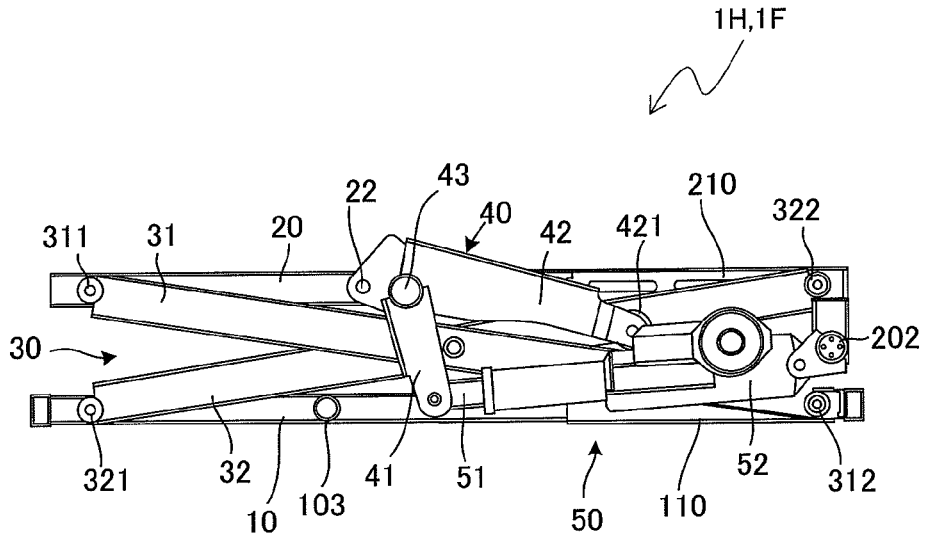
FIG. 15 An illustrative view showing the overall configuration (in a lowered state) of the link type lifting mechanism.
Figure 16:
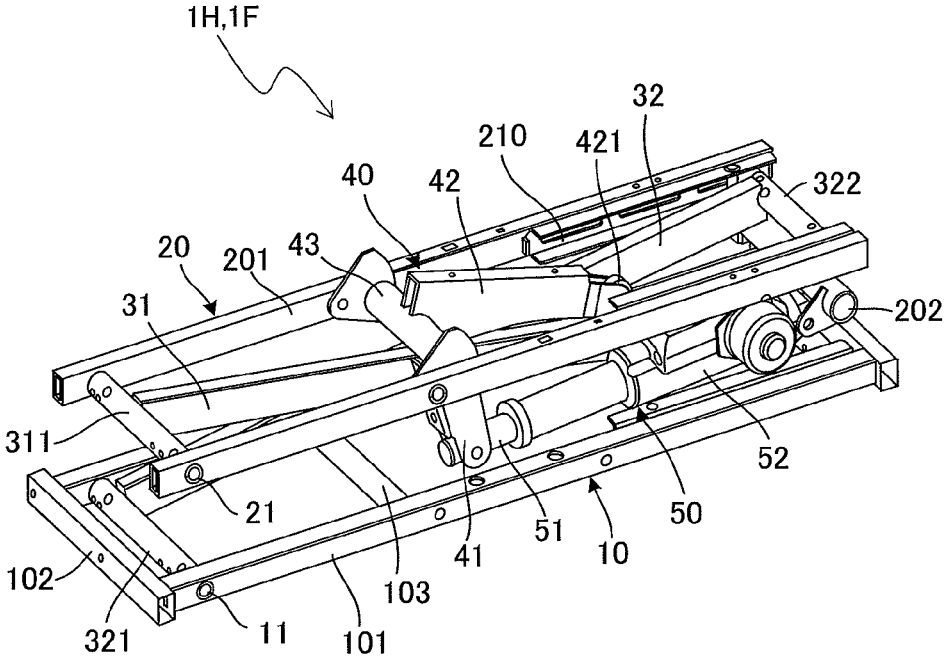
FIG. 16 A perspective view showing the link type lifting mechanism in the lowered state.

FIG. 10 is an illustrative view showing a configuration of the lower frame of the bed apparatus of the present embodiment. FIG. 11 is an enlarged view of an area A in FIG. 10, showing the arrangement of a supporting part of the lower frame for supporting the upper frame. FIG. 12 is an enlarged view of an area B in FIG. 10, showing the arrangement of a retention roller of the lower frame for retaining the upper frame. FIG. 13 is an illustrative view showing the overall configuration (in a raised state) of the link type lifting mechanism constituting the lower frame. FIG. 14 is an exploded view showing the configuration of the link type lifting mechanism. FIG. 15 is an illustrative view showing the overall configuration (in a lowered state) of the link type lifting mechanism. FIG. 16 is a perspective view showing the link type lifting mechanism in a lowered state.

The lower frame 1B of the bed apparatus 1A of the present embodiment includes, as shown in FIG. 10, the head-side link type lifting mechanism 1H and the foot-side link type lifting mechanism 1F and the connection frame 7 for coupling the link type lifting mechanisms 1H and 1F.

First, the configuration of the head-side link type lifting mechanism 1H and foot-side link type lifting mechanism 1F that characterize the present invention will be described with reference to the drawings.

The link type lifting mechanism 1 according to the present exemplary embodiment is a link type lifting mechanism in which, as shown in FIG. 13, an X-linkage 30 that is formed of a first link 31 and a second link 32 pivotally coupled at their middle points by a joint 33 (which will be referred to hereinbelow as "middle joint 33") is provided between a base assembly 10 and a lift assembly 20 that are vertically arranged in layers.

As a specific feature, in addition to the X-linkage 30, a third link 40 and a linear actuator (driving means) 50 for driving the third link 40 are arranged between the base assembly 10 and the lift assembly 20.

The base assembly 10 is formed of a rectangular frame structure of a pair of long frames 101, 101 and a pair of short frames 102, 102, as shown in FIG. 14. A reinforcement pipe 103 is connected between the long frames 101, 101 inside the frame structure.

Arranged at one end 101*a* of the long frame 101 is a joint (which will be referred to hereinbelow as "second link joint) to which one end 32*a* of the second link 32 is rotatably connected. At the other end 101*b*, a guide member 110 for slidably guiding the other end 31*b* of the first link 31 is provided.

As shown in FIG. 14, the lift assembly 20 is formed of a frame structure of a pair of long frames 201, 201 and a joint pipe 202 to which the linear actuator 50 is connected.

Arranged at one end 201*a* of the long frame 201 is a joint (which will be referred to hereinbelow as "first link joint) to which one end 31*a* of the first link 31 is rotatably connected. At the other end 201*b*, a guide member 210 for slidably guiding the other end 32*b* of the second link 32 is provided. Further, a third link joint 22 to which the third link 40 is rotatably coupled is arranged between long frames 201 and 201 around the center area.

The first link 31 and second link 32 are formed of a rectangular pipe having a rectangular section, and may be made of metal such as steel, aluminum, and stainless steel so as to provide a structure excellent in strength.

The first link 31 is arranged so that its one end 31*a* is pivotally coupled with the first link joint 21 of the lift assembly 20 while the other end 31*b* is coupled with the base assembly 10 so as to slidable therealong.

Provided at the end 31*a* of the first link 31 is a joint pipe (which will be referred to hereinbelow as "first link joint pipe") 311 that is rotatably coupled with the first link joint 21 between the long frames 201 and 201 of the lift assembly 20, as shown in FIG. 14. Provided at the other end 31*b* is a joint pipe (which will be referred to hereinbelow as "first link moving joint pipe") 312 having a guide roller 313 to be slidably guided along the guide members 110 between long frames 101 and 101 of the base assembly 10.

The second link 32 is arranged so that its one end 32*a* is pivotally coupled with the second link joint 11 of the base assembly 10 while the other end 32*b* is coupled with the lift assembly 20 so as to be movable therealong.

Provided at the end 32*a* of the second link 32 is a joint pipe (which will be referred to hereinbelow as "second link joint pipe") 321 that is rotatably coupled with the second link joint 11 between the long frames 101 and 101 of the base assembly 10, as shown in FIG. 14. Provided at the other end 32*b* is a joint pipe (which will be referred to hereinbelow as "second link moving joint pipe") 322 having a guide roller 323 to be slidably guided along the guide members 210 between long frames 201 and 201 of the lift assembly 20.

The first link 31 and the second link 32 have the same length.

Specifically, the part from the first link joint pipe 311 to the middle joint 33 is formed to be equal in length to the part from the second link moving joint pipe 322 to the middle joint 33. The part from the second link joint pipe 321 to the middle joint 33 is formed to be equal in length to the part from the first link moving joint pipe 312 to the middle joint 33.

With this configuration, the X-linkage 30 formed of the first link 31 and the second link 32 enables the lift assembly 20 to move up and down parallel to the base assembly 10.

As shown in FIGS. 13 and 14, the third link 40 has, at its one end 40*a*, a joint pipe (which will be referred to hereinbelow as "third link joint pipe") 43 that is rotatably coupled with the third link joint 22 between the long frames 201 and 201 of the lift assembly 20 while a drive arm 41 and a functional arm 42 are provided with their ends integrally joined to the third link joint pipe 43.

The drive arm 41 has a joint 411 at the other end 41*b* to be coupled with the linear actuator 50. The drive arm 41 is configured to rotate about the third link joint 22 of the lift assembly 20 as the drive actuator 50 moves.

The functional arm 42 is provided at the other end 42*b* with a rotary roller 421 abutting the first link 31. The functional arm 42 is configured to rotate the rotary roller 421 upwards and downwards about the third link joint 22 of the lift assembly 20 by linking the drive arm 41 moves, to rotate the first link 31 about the first link joint 21 of the lift assembly 20 by pushing the rotary roller 421 against the first link 31.

As shown in FIG. 13, the rotary roller 421 is arranged so as to come into and out of contact with the upper surface, designated at 31*c* of the first link 31. By this arrangement, the drive force of the linear actuator 50 urges the lift assembly 20 in the raising direction only by pressing the rotary roller 421 against the first link 31.

The linear actuator 50 is an electric cylinder having a rod 51 that can be expanded and contracted by motor drive and is arranged as shown in FIG. 13 so that the front end 51*a* of the rod 51 is coupled with the joint 411 of the drive arm 41 of the third link 40 while one end 52*a* of the body 52 is pivotally coupled with the joint pipe 202 of the lift assembly 20.

In the present embodiment, as the featuring configuration of the link type lifting mechanism 1, a stopper 210*a* for limiting the movable range of the second link moving joint pipe 322 of the second link 32 is provided for the guide member 210 of the long frame 201 of the lift assembly 20, as shown in FIG. 13.

In the present embodiment, the link type lifting mechanisms 1H and 1F having the above configuration are arranged, as shown in FIGS. 1 and 10, respectively on the head side and foot side under the upper frame 2 with the longitudinal direction of the lift assembly 20 (the longitudinal direction of the long frames 201) oriented in the width direction of the upper frame 2.

Further, in the present embodiment, in the head-side link type lifting mechanism 1H, a pair of supports 220 that are engaged with part of the upper frame 2 to rotatably support the upper frame 2 are provided in the long frame 201 of the lift assembly 20.

On the other hand, in the foot-side link type lifting mechanism 1F, as shown in FIGS. 10 and 12 a pair of retention rollers 230 that are engaged with part of the upper frame 2 to retain the upper frame 2 and movable along the longitudinal direction of the upper frame are provided in the long frame 201 of the lift assembly 20.

As described above, provision of the supports 220 that rotatably support the upper frame 2 for the head-side link type lifting mechanism 1H and provision of retention rollers 230 that movably retain the upper frame 2 for the foot-side link type lifting mechanism 1F make it possible to stably support the upper frame 2 by the retention rollers 230 even if the upper frame 2 moves in the longitudinal direction when a tilting operation of the upper frame 2 is performed.

Further, in the present embodiment a lift-side joint 170 to which the connection frame 7 is joined is provided in the center of the long frame 101 of the base assembly 10 of each of the head-side link type lifting mechanism 1H and the foot-side link type lifting mechanism 1F, as shown in FIG. 10.

Next, the connection frame 7 will be described with reference to the drawings.

Figure 17:
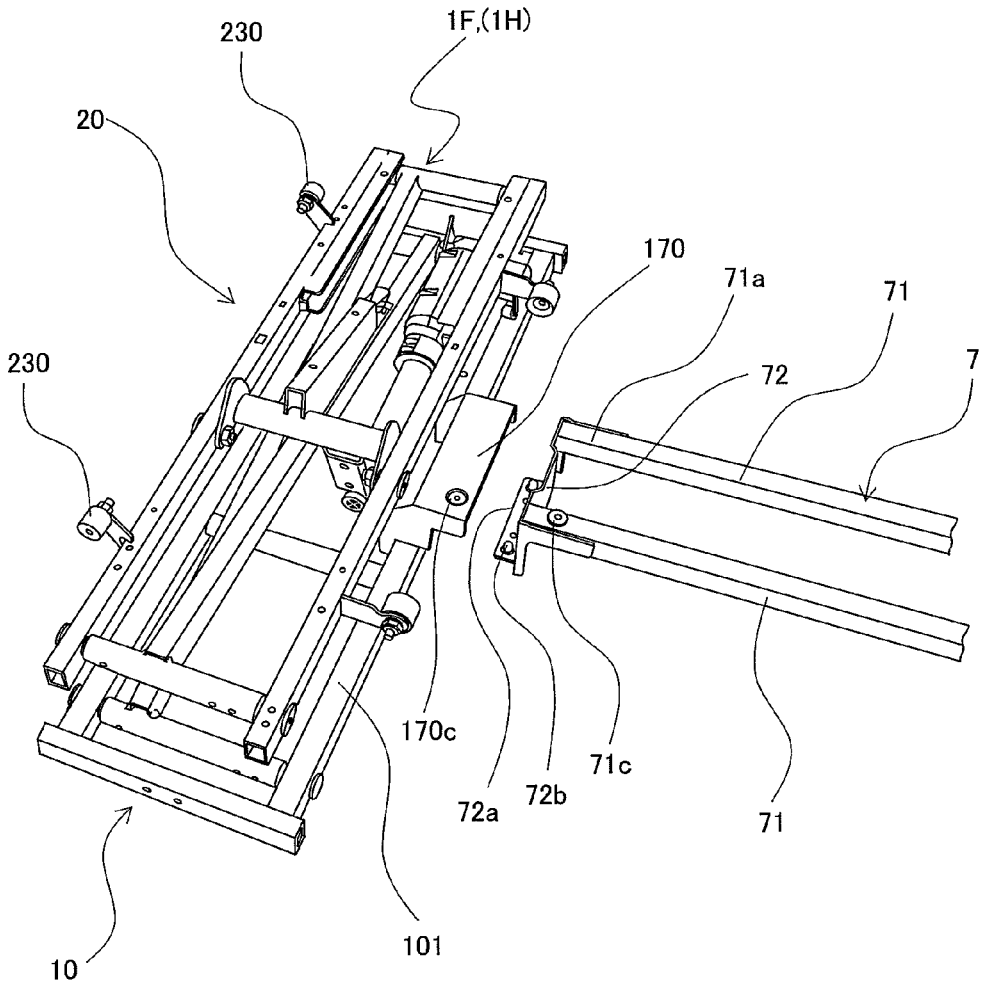
FIG. 17 An illustrative view showing a coupling relation between a link type lifting mechanism and a connection frame.
Figure 18:
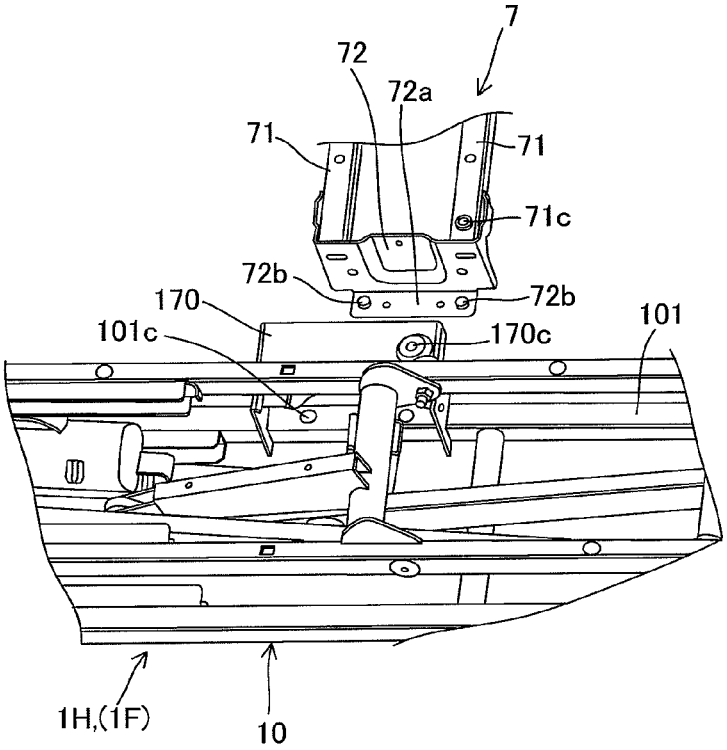
FIG. 18 An illustrative view showing a configuration of a joint between the link type lifting mechanism and the connection frame.
Figure 19:
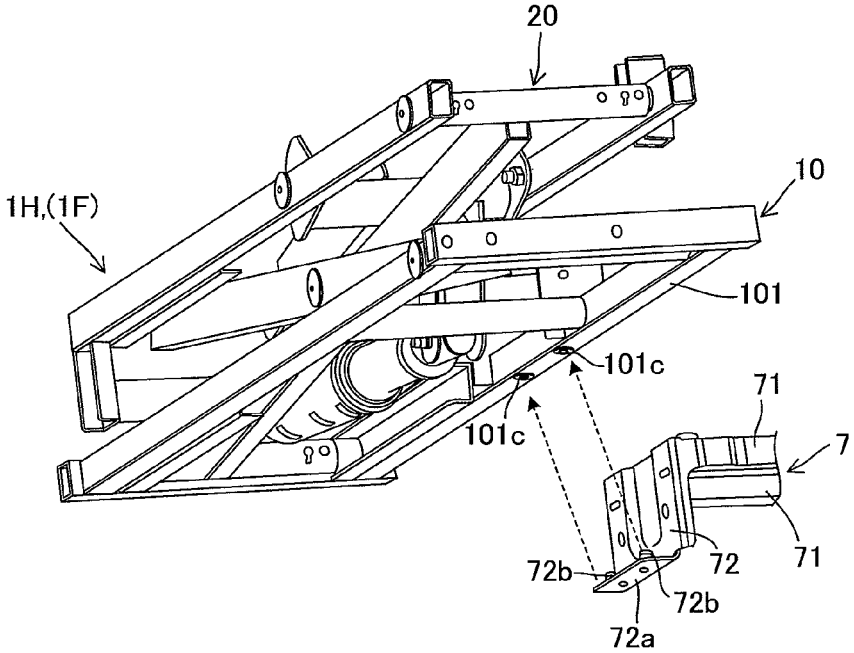
FIG. 19 An illustrative view showing the positions of positioning holes in the link type lifting mechanism.
Figure 20:
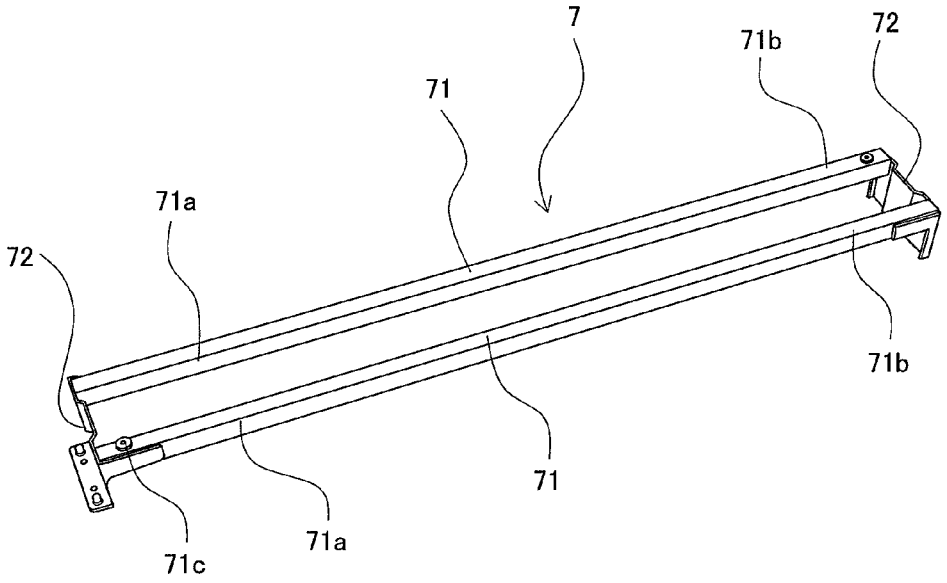
FIG. 20 An illustrative view showing a configuration of the connection frame forming the lower frame.
Figure 21:
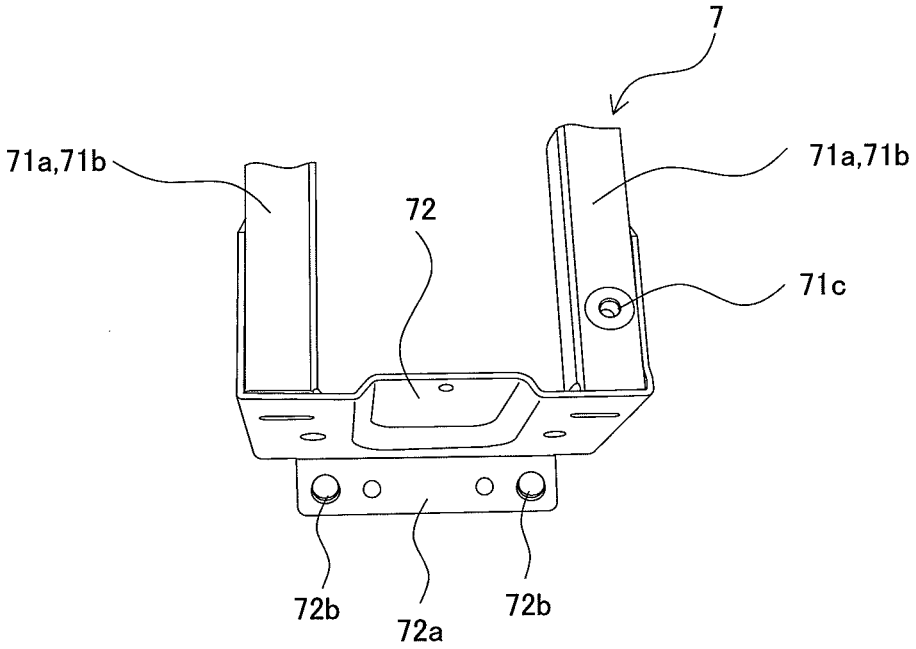
FIG. 21 An illustrative view showing a configuration of the joint of the connection frame.
Figure 22:
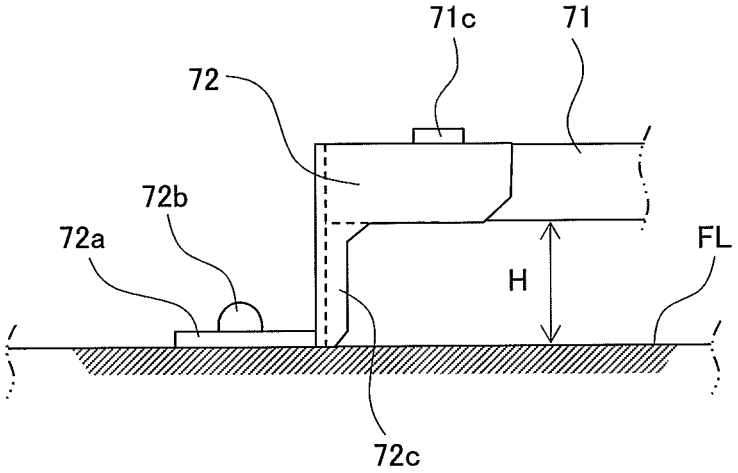
FIG. 22 A side view showing a configuration of the joint of the connection frame.
Figure 23:
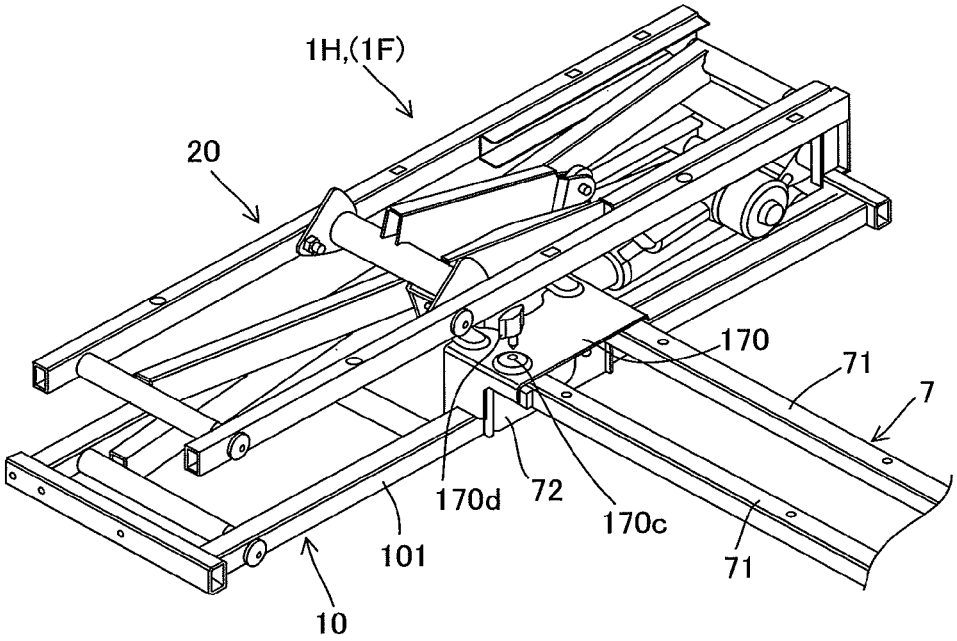
FIG. 23 An illustrative view showing a state of coupling between the link type lifting mechanism and the connection frame.
Figure 24:
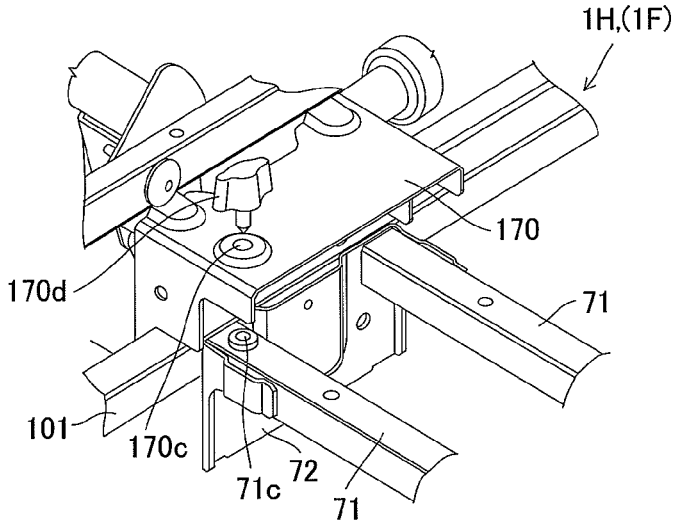
FIG. 24 An illustrative view showing a configuration of a lift side joint of the link type lifting mechanism and a joint on the connection frame side.

FIG. 17 is an illustrative view showing a coupling relation between the link type lifting mechanism and the connection frame in the bed apparatus of the present embodiment. FIG. 18 is an illustrative view showing a configuration of the joint between the link type lifting mechanism and the connection frame. FIG. 19 is an illustrative view showing the positions of positioning holes in the link type lifting mechanism. FIG. 20 is an illustrative view showing a configuration of the connection frame forming the lower frame of the bed apparatus. FIG. 21 is an illustrative view showing a configuration of the joint of the connection frame. FIG. 22 is a side view showing a configuration of the joint of the connection frame. FIG. 23 is an illustrative view showing a state of coupling between the link type lifting mechanism and the connection frame. FIG. 24 is an illustrative view showing a configuration of the lift side joint of the link type lifting mechanism and the joint on the connection frame side.

Next, the connection frame 7 of the present embodiment is formed of, as shown in FIGS. 17 and 20, an approximately rectangular frame structure formed of a pair of long frames 71, 71 arranged in parallel, a pair of frame-side joints 72, 72 located at both longitudinal ends 71*a* and 71*b*.

As shown in FIG. 10, the connection frame 7 is constructed such that the dimension or distance between two long frames 71, 71 arranged in parallel is shorter than the width of the upper frame 2 (the length in the width direction of the bed) and the length of the long frames 101 of the head-side link type lifting mechanism 1H and foot-side link type lifting mechanism 1F, and is disposed in the approximate center of the long frames 101.

The long frames 71 are formed of a rectangular pipe having a rectangular section, and may be made of metal such as steel, aluminum, and stainless steel so as to provide a structure excellent in strength.

As shown in FIGS. 17, 18 and 19, the frame-side joint 72 and an attachment 71*c* for attachment to the link type lifting mechanisms 1H and 1F are arranged in both end parts 71*a* and 71*b* of the long frames 71.

In the link type lifting mechanisms 1H and 1F, the lift-side joint 170 that is fixed to the attachment 71*c* is provided for the long frame 101 on the attachment side of the connection frame 7 in the base assembly 10, as shown in FIG. 17. Further, this long frame 101 has a pair of fitting holes (positioning portions) 101*c* formed on the underside in the center thereof to position the connection frame 7, as shown in FIGS. 18 and 19.

As shown in FIGS. 20 and 21, the frame-side joints 72 are each formed in an angled U-shape when viewed from above, and disposed at both ends 71*a* and 71*b* of the two long frames 71, 71 and integrally joined to the long frames 71 and 71 so as to place the frames 71, 71 parallel to each other with a spacing therebetween.

As shown in FIG. 22, the frame-side joint 72 has a connecting part 72*a* extended downward in an approximately L-shape below the long frames 71, 71.

As shown in FIG. 19, the connecting part 72*a* is formed with fitting pieces (positioning parts) 72*b* to be positioned to the fitting holes 101*c* formed in the long frame 101 of the base assembly 10 in the link type lifting mechanisms 1H and 1F. The fitting pieces 72*b* are formed side by side and projected semi-spherically upward by a so-called dowel-forming process, as shown in FIGS. 21 and 22.

In the present embodiment, the frame-side joint 72 is pressed to form indentation and projection on the side facing the link type lifting mechanism 1H, 1F as shown in FIG. 21 and formed with bends 72*c* in the side edges of the portion upright from the connecting part 72*a* of the L-shaped structure, as shown in FIG. 22, whereby the connected portion is enhanced in rigidity.

The lift-side joint 170 is projected and integrally formed in the center of the long frame 101 in the base assembly 10, as shown in FIG. 17. An attachment hole 170*c* is formed on the top of the lift-side joint 170, at a position corresponding to the attachment 71*c* formed in the connection frame 7, as shown in FIGS. 23 and 24.

The lift-side joint 170 and the frame-side joint 72 are joined by raising the link type lifting mechanism 1H, 1F from the condition shown in FIG. 17 to fit the fitting pieces 72*b* of the connecting part 72*a* of the frame-side joint 72 into the fitting holes 101*c* formed in the long frame 101 of the base assembly 10 as shown in FIG. 19 while laying the attachment hole 170*c* of the lift-side joint 170 over the attachment 71*c* formed in the connection frame 7, as shown in FIGS. 23 and 24. Then, a knob bolt (attachment bolt) 170*d* is screwed to the attachment 71*c* to fix the lift-side joint 170 to the connection frame 7. Thus, the connection frame 7 is joined to the link type lifting mechanisms 1H and 1F, as shown in FIG. 2.

The bed apparatus 1A of the present embodiment is configured so that, in the state where the connection frame 7 is fixed to the link type lifting mechanisms 1H and 1F, a spacing of a height H can be formed between the bottom of the long frames 71 of the connection frame 7 and the floor surface FL, as shown in FIGS. 1 and 22.

This height H is set so as to exceed the height of nursing care equipment when nursing care equipment is laid around the bed. This specification allows the base (feet) of nursing care equipment to be put under the long frames 71 of the connection frame 7.

Next, lifting operations by the link type lifting mechanisms 1H and 1F of the present embodiment will be described in detail with reference to the drawings.

In the link type lifting mechanisms 1H and 1F, when the lift assembly 20 is positioned at the lowest position, the lift assembly 20 is located close to the base assembly 10 so that the first link 31 and second link 32 are gently inclined or laid down (at a small tilt angle), as shown in FIGS. 15 and 16.

The linear actuator 50 is located between the base assembly 10 and the lift assembly 20 in such a state that the rod 51 is retracted inside the body 52.

As shown in FIG. 13, the drive arm 41 is placed so that the joint 411 coupled with the linear actuator 50 is located at a position (closer to the other end 31*b* of the first link 31) on the right side in the drawing of the third link joint 22 coupled with the lift assembly 20.

The functional arm 42 is placed so that the rotary roller 421 is located at a position on the upper surface 31*c* closer to the other end 31*b* of the first link 31, on the right side in the drawing of the third link joint pipe 43 and the third link joint 22 of the lift assembly 20 while the arm body is inclined along the first link 31.

First, when the lift assembly 20 is moved up, the linear actuator 50 is driven to extend the rod 51 so as to turn the drive arm 41 leftward in the drawing, as shown in FIG. 13. In link with the action of the drive arm 41, the functional arm 42 rotates downward in the drawing.

As the functional arm 42 rotates downward, the rotary roller 421 pushes down the upper surface 31*c* of the other end 31*b* of the first link 31 so that force acts in a direction of pushing the third link joint 22 of the lift assembly 20 upward. As a result, the first link 31 rotates about the first link joint pipe 311 on the lift assembly 20 side as a fulcrum so that the first link moving joint pipe 312 moves leftward in the drawing to widen the tilt angle θ1.

With this, the second link 32 coupled at the middle joint 33, similarly to the motion of the first link 31, rotates about the second link joint pipe 321 on the base assembly 10 side as a fulcrum so that the second link moving joint pipe 322 moves leftward in the drawing to widen the tilt angle θ2. As a result, the lift assembly 20 is moved upward. In this case, the tilt angles θ1 and θ2 always take the same value.

Thus, the lift assembly 20 can move up while remaining parallel to the base assembly 10.

Next, when the lift assembly 20 is moved down, the opposite control to that for the raising control described above is performed.

That is, as shown in FIGS. 13 to 15, the linear actuator 50 is driven to contract the rod 51 so as to rotate the drive arm 41 rightward in the drawing. In link with the action of the drive arm 41, the functional arm 42 rotates upward in the drawing.

As the functional arm 42 rotates upward, pressing of the rotary roller 421 onto the upper surface 31*c* of the other end 31*b* of the first link 31 is released so that the lift assembly 20 moves down due to gravity, following the amount of rotation (the amount of motion) of the functional arm 42. As a result, the first link 31 rotates about the first link joint pipe 311 as a fulcrum so that the first link moving joint pipe 312 moves rightward in the drawing to narrow the tilt angle θ1.

With this, the second link 32 coupled at the middle joint 33, similarly to the motion of the first link 31, rotates about the second link joint pipe 321 as a fulcrum so that the second link moving joint pipe 322 moves rightward in the drawing to narrow the tilt angle θ2. In this case, the tilt angles θ1 and θ2 always take the same value.

Thus, the lift assembly 20 can be lowered while remaining parallel to the base assembly 10.

Next, the characteristic operation of lifting the upper frame 2 in the bed apparatus 1A of the present embodiment will be described in detail with reference to the drawings.

Figure 25:
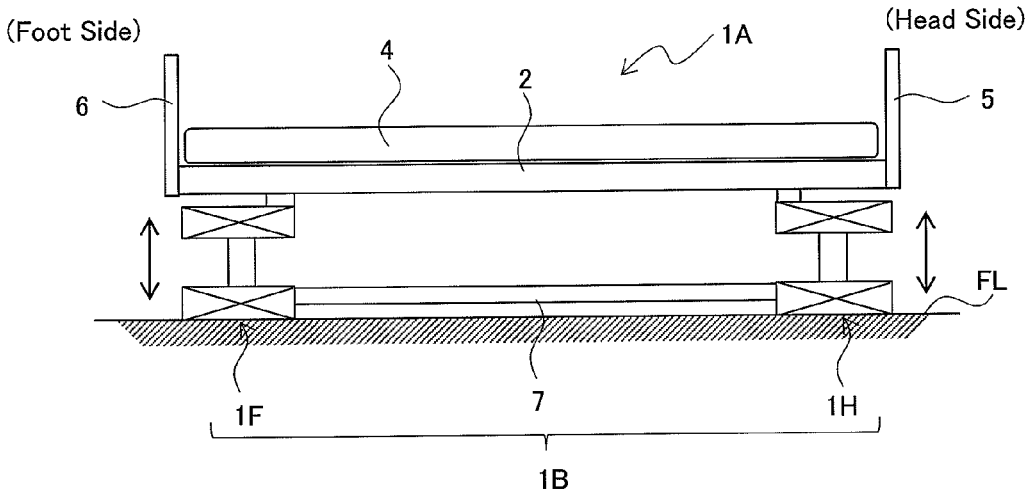
FIG. 25 An illustrative diagram showing a state where the upper frame is raised parallel in the bed apparatus.
Figure 26:
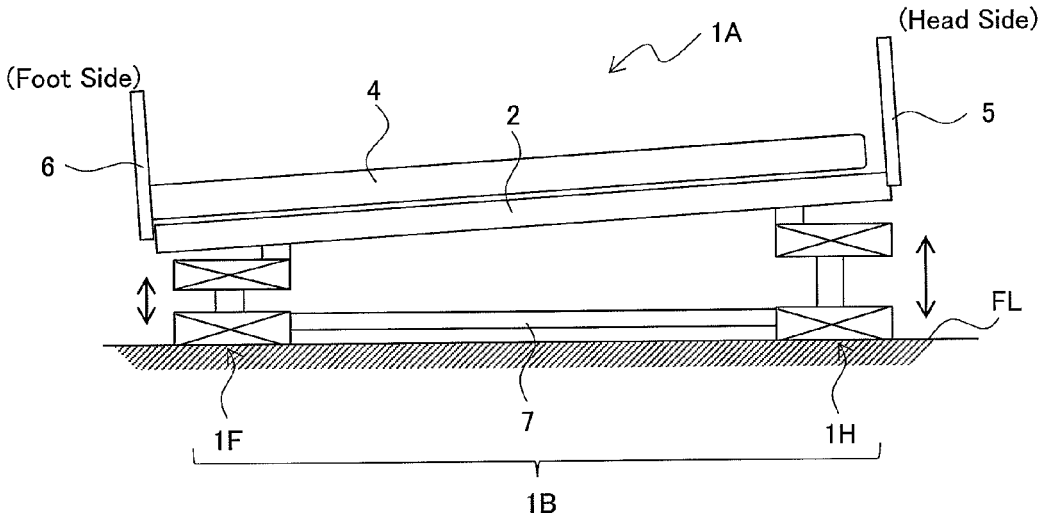
FIG. 26 An illustrative diagram showing a state where the bed apparatus is tilted with the head side higher.
Figure 27:
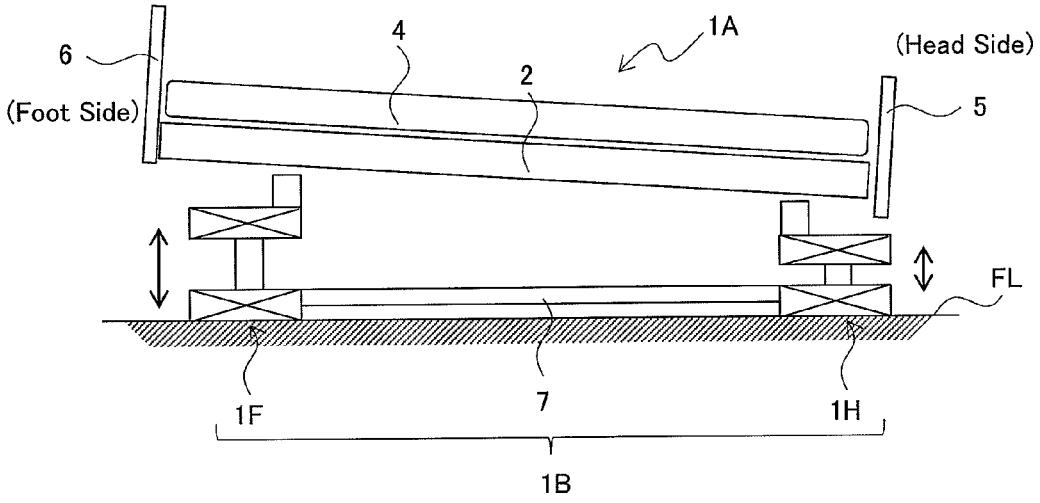
FIG. 27 An illustrative diagram showing a state where the bed apparatus is tilted with the foot side higher.

FIG. 25 is an illustrative diagram showing a state where the upper frame is raised parallel in the bed apparatus of the present embodiment. FIG. 26 is an illustrative diagram showing a state where the bed apparatus is tilted with the head side higher. FIG. 27 is an illustrative diagram showing a state where the bed apparatus is tilted with the foot side high.

First, when the upper frame 2 of the bed apparatus 1A is raised parallel, the head-side link type lifting mechanism 1H and the foot-side link type lifting mechanism 1F are controlled to move up in synchronization with each other, whereby the upper frame 2 is transitioned from the state shown in FIG. 1 to the state shown in FIG. 25.

As a result, the upper frame 2 can be moved up parallel to the floor surface FL, keeping the head side and foot side of the upper frame 2 horizontal.

When the upper frame 2 of the bed apparatus 1A is lowered parallel, the head-side link type lifting mechanism 1H and the foot-side link type lifting mechanism 1F may be controlled to move down in synchronization with each other.

Next, when the upper frame 2 of the bed apparatus 1A is tilted with the head side higher, the head-side link type lifting mechanism 1H is controlled to move up, whereby the upper frame 2 is transitioned from the state shown in FIG. 1 to the state shown in FIG. 26. When the bed floor sections of the bed apparatus 1A, set at the highest position (in the state where the bed has been raised to the highest position), is tilted with the head side higher, the foot-side link type lifting mechanism 1F is lowered.

When the bed floor sections of the bed apparatus 1A has been set at a medium position in the adjustable range, tilting the bed floor sections with the head side higher may be performed by raising the head-side link type lifting mechanism 1H and lowering the foot-side link type lifting mechanism 1F.

Thus, it is also possible to perform an operation of tilting the upper frame 2 with the head side higher by control the lifting operation in the head-side link type lifting mechanism 1H and the lifting operation in the foot-side link type lifting mechanism 1F, in combination.

Next, when the upper frame 2 of the bed apparatus 1A is tilted with the foot side higher, the foot-side link type lifting mechanism 1F is controlled to move up, whereby the upper frame 2 is transitioned from the state shown in FIG. 1 to the state shown in FIG. 27. When the bed floor sections of the bed apparatus 1A, set at the highest position, is tilted with the foot side higher, the head-side link type lifting mechanism 1H is lowered.

When the bed floor sections of the bed apparatus 1A has been set at a medium position in the adjustable range, tilting the bed floor sections with the foot side higher may be performed by raising the foot-side link type lifting mechanism 1F and lowering the head-side link type lifting mechanism 1H.

Thus, it is also possible to perform an operation of tilting the upper frame 2 with the foot side higher by control the lifting operation in the head-side link type lifting mechanism 1H and the lifting operation in the foot-side link type lifting mechanism 1F, in combination.

As described heretofore, in the bed apparatus 1A of the present embodiment, the user's posture can be changed by use of the back-raising mechanism 8 and the knee-raising mechanism 9 in the upper frame 2 while the upper frame 2 can be tilted by use of the head-side link type lifting mechanism 1H and the foot-side link type lifting mechanism 1F under the upper frame 2. Accordingly, it is possible to create a suitable posture for the user by operating the back-raising mechanism 8, the knee-raising mechanism 9 and the link type lifting mechanisms 1H and 1F, in combination.

Specifically, in a case where, for example, the user wants to raise their upper body on the bed, the link type lifting mechanisms 1H and 1F are adapted to tilt the entire bed with the head side up before the upper body is raised by the back-raising mechanism 8, then the upper body is raised by the back-raising mechanism 8. This operation makes it possible to alleviate physical burdens when the user raises the upper body.

Further, when the user is made to take a posture with the legs bent by raising knees by means of the knee-raising mechanism 9 before the link type lifting mechanisms 1H and 1F tilt the entire bed with the head side up, it is possible to prevent the user from slipping down toward the foot side of the bed.

According to the present embodiment having the configuration described above, when, in the bed apparatus 1A including the back-raising mechanism 8 and the knee-raising mechanism 9 in the upper frame 2, the link type lifting mechanisms 1H and 1F are arranged on the head side and the foot side, respectively under the upper frame 2, it is possible to distribute the loads (load acting on the upper frame, the weight of the upper frame itself and weights of other components acting on the link type lifting mechanisms) on the link type lifting mechanisms 1H and 1F, to the head side and the foot side. Accordingly, it is possible to make the structure of each of the link type lifting mechanisms on the head and foot sides lightweight and compact. As a result, it is possible to realize a bed apparatus that is easy to convey, assemble and disassemble and is excellent in work efficiency and maintenance performance.

The thus configured bed apparatus is the best for the bed to be used at home where much help cannot be expected.

According to the present embodiment, since the connection frame 7 that integrally joins the link type lifting mechanisms to each other is provided between the head-side link type lifting mechanism 1H and the foot-side link type lifting mechanism 1F, the lower frame that supports the upper frame 2 can be simply constructed without providing any base frame (framework) and the like for mounting the link type lifting mechanisms 1H and 1F. That is, the lower frame can be separated into three parts, the head-side link type lifting mechanism 1H, the foot-side link type lifting mechanism 1F and the connection frame 7, hence it is possible to provide a lightweight and compact lower frame.

Further, according to the present embodiment, since the operations of the back-raising mechanism 8, the knee-raising mechanism 9 and the head-side and foot-side link type lifting mechanisms 1H and 1F can be controlled individually or in cooperation, it is possible to operate each mechanism individually or perform an operation by combining back-raising operation and bed floor sections lifting operation in combination. It is therefore possible to easily perform a movement of changing the posture of the user. As a result, it is possible to readily adjust the user's posture to the position the user wants.

In the present embodiment, the link type lifting mechanisms 1H and 1F each have the X-linkage 30 formed of the first link 31 and the second link 32 that are rotationally coupled at their medium positions and act on the lift assembly 20, the third link 40 acting on the linkage 30 and the linear actuator 50 that drives the third link 40, arranged between the base assembly 10 and the lift assembly 20, and the lift assembly 20 is urged in only the direction by the linear actuator 50 pressing the rotary roller 421 against the first link 31. Accordingly, the linking mechanism can be simplified and made compact without using a framework structure, thus making it possible to reduce costs and improve assembly efficiency and maintenance performance. Further, this configuration makes the lift assembly 20 free from linkage in lowering operation, it is hence possible to reduce the risk of property damage, or equipment being caught as a result of drive of the linear actuator 50 during the lowering operation of the lift assembly 20.

Further, since the present embodiment includes the back-raising mechanism 8 for raising up the back bottom 3*a* as a raising/lowering mechanism while the back-raising links 82 are configured to urge the back bottom 3*a* in the pushing-up (raising) direction only by the linear actuator 83 via the rotary roller 821 that presses the back bottom frame 81, it is possible to perform back-raising operations smoothly and make the back bottom 3*a* free from linkage in back-lowering operation. Accordingly, it is possible to perform a back-raising operation manually without relaying on the linear actuator 83. As result, it is possible to improve work efficiency and maintenance performance. It is also possible to reduce the risk of property damage, or equipment being caught as a result of drive of the linear actuator 83 in back lowering operation.

Further, since the present embodiment includes the knee-raising mechanism 9 for raising up the knee bottom 3*c* as a raising/lowering mechanism while the knee-raising links 92 are configured to urge the knee bottom 3*c* in the pushing-up (raising) direction only by the linear actuator 93 via the rotary roller 921 that presses the knee bottom 3*c*, it is possible to perform knee-raising operations smoothly and make the knee bottom 3*c* free from linkage in knee-lowering operation. Accordingly, it is possible to perform a knee-raising operation manually without relaying on the linear actuator 93. As result, it is possible to improve work efficiency and maintenance performance and reduce the risk of property damage, or equipment being caught as a result of drive of the linear actuator 93 at knee lowering operation.

Here, in the present embodiment, as the configuration of the bed apparatus 1A the upper frame 2 is equipped with the back-raising mechanism 8 and the knee-raising mechanism 9, each having a driving means as a raising/lowering mechanism. However, the present invention should not be limited to this apparatus configuration.

As variational examples, back-raising and knee-raising mechanisms may be mechanically linked to form a raising/lowering mechanism that is driven by a single driving means or only a back-raising mechanism may be provided.

Here, the present invention should not be limited to the above embodied modes and variational examples, but various changes can be made within the scope of the claims. That is, any embodied mode obtained by combination of technical means modified as appropriate without departing from the spirit and scope of the present invention should be included in the technical art of the present invention.

INDUSTRIAL APPLICABILITY

The bed apparatus of the present invention can be applied to beds for medical, nursing care and in-home purposes.

DESCRIPTION OF REFERENCE NUMERALS

1 link type lifting mechanism
1A bed apparatus
1B lower frame
1F foot-side link type lifting mechanism
1H head-side link type lifting mechanism
2 upper frame
2F foot-side frame (upper frame)
2H head-side frame (upper frame)
3 bottoms (bed floor sections)
3*a* back bottom (back section)
3*c* knee bottom (knee section)
7 connection frame
8, 108 back-raising mechanism (raising/lowering mechanism)
9 knee-raising mechanism (raising/lowering mechanism)
10 base assembly
20 lift assembly
31 first link

32 second link
40 third link
50, 83, 93 linear actuator
81 back bottom frame
82 back-raising link
85 first link
86 second link
92 knee-raising link
θ1, θ2 tilt angle

The invention claimed is:

1. A bed apparatus comprising:

an upper frame including a raising/lowering mechanism for raising/lowering a bed floor section;

a head-side lifting mechanism and a foot-side lifting mechanism that are arranged under the upper frame so as to be able to move up and down the upper frame;

a connection member that couples the head-side lifting mechanism with the foot-side lifting mechanism so as to be able to be disassembled, and is arranged between the head-side lifting mechanism and the foot-side lifting mechanism; and a control portion that controls, individually or in cooperation, the raising/lowering mechanism, the head-side lifting mechanism and the foot-side lifting mechanism, wherein the connection member includes a first positioning part at each end, the head-side lifting mechanism includes a head-side second positioning part, the foot-side lifting mechanism includes a foot-side second positioning part, one first positioning part engages with the head-side second positioning part, and the other first positioning part engages with the foot-side second positioning part.

2. The bed apparatus according to claim 1, wherein the head-side lifting mechanism and the foot-side lifting mechanism are link type lifting mechanisms, respectively, and the head-side lifting mechanism and the foot-side lifting mechanism include a stopper, respectively, for limiting a movable range of a link moving portion of the head-side lifting mechanism and the foot-side lifting mechanism.

3. The bed apparatus according to claim 1, wherein the foot-side lifting mechanism includes a retention member that retains the upper frame movably along a longitudinal direction of the upper frame.

4. The bed apparatus according to claim 1, wherein the connection member includes a positioning member for positioning between the connection member and the head-side lifting mechanism and between the connection member and the foot-side lifting mechanism.

5. The bed apparatus according to claim 1, wherein the connection member is configured to form a space in a height direction between an under portion of the connection member and a floor surface, in a state that the connection member is coupled with both the head-side lifting mechanism and the foot-side lifting mechanism.

6. The bed apparatus according to claim 1, wherein the raising/lowering mechanism is configured to tilt the bed floor section in a direction in which a head-side lifting mechanism side of the bed floor section becomes higher than a foot-side lifting mechanism side of the bed floor section or in a direction in which the foot-side lifting mechanism side of the bed floor section becomes higher than the head-side lifting mechanism side of the bed floor section.

7. The bed apparatus according to claim 1, wherein the connection member couples the head-side lifting mechanism with the foot-side lifting mechanism at a center or a vicinity of the center of the width direction of the bed by coupling a one end with an under portion of the head-side lifting mechanism and by coupling the other end with an under portion of the foot-side lifting mechanism.

8. The bed apparatus according to claim 1, wherein a width of the connection member is narrower than a width of the head-side lifting mechanism and a width of the foot-side lifting mechanism in the width direction of the bed.

9. The bed apparatus according to claim 1, wherein the connection member is sandwiched between the head-side lifting mechanism and the foot-side lifting mechanism.

10. The bed apparatus according to claim 1, wherein the raising/lowering mechanism includes a raising/lowering link acting on the bed floor section and a driving portion that drives the raising/lowering link, between the bed floor section and the upper frame, and, the raising/lowering link is configured so that one end is pivotally coupled with the upper frame while the other end is able to come into and out of contact with the bed floor section wherein the driving portion makes the other end abut the bed floor section and urge the bed floor section in the pushing-up direction only.

11. The bed apparatus according to claim 10, wherein the bed floor section includes a back section for an upper body, the raising/lowering mechanism includes a back section-raising/lowering mechanism for raising and lowering the back section, the back section-raising/lowering mechanism includes a back section-raising/lowering link acting on the back section as the raising/lowering link, and a driving portion that drives the back section-raising/lowering link, between the back section and the upper frame, and, the back section-raising/lowering link is configured so that one end is pivotally coupled with the upper frame side while the driving portion makes the other end abut the back section and urge the back section in the pushing-up direction only.

12. The bed apparatus according to claim 10, wherein the bed floor section includes a knee section for knee bending, the raising/lowering mechanism includes a knee section-raising/lowering mechanism for raising and lowering the knee section, the knee section-raising/lowering mechanism includes a knee section-raising/lowering link acting on the knee section as the raising/lowering link, and a driving portion that drives the knee section-raising/lowering link, between the knee section and the upper frame, and, the knee section-raising/lowering link is configured so that one end is pivotally coupled with the upper frame side while the driving portion makes the other end abut the knee section and urge the knee section in the pushing-up direction only.

13. The bed apparatus according to claim 10, wherein the bed floor section includes a back section for an upper body, the raising/lowering mechanism includes a back section-raising/lowering mechanism for raising and lowering the back section, and the back section in the bed floor section is tilted upward while being shifted toward the head side.

14. The bed apparatus according to claim 1, wherein the head-side lifting mechanism and the foot-side lifting mechanism each include the same constructed linkage, and the linkages are placed face to face.

15. The bed apparatus according to claim 1, wherein the head-side lifting mechanism and the foot-side lifting mechanism each have an X-linkage formed of a first link and a second link that are rotationally coupled at their medium positions and act on a lift assembly, and are arranged between a base assembly and the lift assembly, the first link is arranged so that one end is pivotally coupled with the lift assembly and the other end is coupled with the base assembly so as to move along the base assembly, the second link is arranged so that one end is pivotally coupled with the base assembly and the other end is coupled with the lift assembly so as to move along the lift assembly, a third link acting on the X-linkage and a driving portion that drives the third link being provided between the base assembly and the lift assembly, and, the third link is arranged so that one end is pivotally coupled with the base assembly or the lift assembly while the other end is arranged so as to come into or out of contact with the first link or the second link, wherein the driving portion makes the other end abut the first link or the second link and urge the lift assembly in the raising direction only.

16. The bed apparatus according to claim 1, wherein the connection member can couple the head-side lifting mechanism with the foot-side lifting mechanism, by an attachment which can be hand tightening.

* * * * *